US007783060B2

(12) United States Patent
Brooks et al.

(10) Patent No.: US 7,783,060 B2
(45) **Date of Patent: *Aug. 24, 2010**

(54) DECONVOLUTION METHODS AND SYSTEMS FOR THE MAPPING OF ACOUSTIC SOURCES FROM PHASED MICROPHONE ARRAYS

(75) Inventors: Thomas F. Brooks, Seaford, VA (US); William M. Humphreys, Jr., Newport News, VA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 1417 days.

This patent is subject to a terminal disclaimer.

(21) Appl. No.: 11/126,518

(22) Filed: May 10, 2005

(65) Prior Publication Data

US 2006/0256975 A1 Nov. 16, 2006

(51) Int. Cl.
*H04R 3/00* (2006.01)

(52) U.S. Cl. ..... 381/92; 381/91; 381/122; 367/118; 367/119

(58) Field of Classification Search ..... 381/91–92, 381/56–57, 66, 122; 367/118–119
See application file for complete search history.

(56) References Cited

U.S. PATENT DOCUMENTS 4,741,038 A * 4/1988 Elko et al. ..... 381/92
5,500,903 A * 3/1996 Gulli ..... 381/92
7,269,263 B2 * 9/2007 Dedieu et al. ..... 381/92

OTHER PUBLICATIONS

Thomas F. Brooks, "A Deconvolution Approach for the Mapping of Acoustic Sources (DAMAS) Determined from Phased Microphone Arrays," 10th AIAA/CEAS Aeroacoustics Conference, AIAA (Manchester, UK), (May 10, 2004).

* cited by examiner

*Primary Examiner*—Xu Mei
*Assistant Examiner*—Disler Paul
(74) *Attorney, Agent, or Firm*—Helen M. Galus

(57) ABSTRACT

A method and system for mapping acoustic sources determined from a phased microphone array. A plurality of microphones are arranged in an optimized grid pattern including a plurality of grid locations thereof. A linear configuration of N equations and N unknowns can be formed by accounting for a reciprocal influence of one or more beamforming characteristics thereof at varying grid locations among the plurality of grid locations. A full-rank equation derived from the linear configuration of N equations and N unknowns can then be iteratively determined. A full-rank can be attained by the solution requirement of the positivity constraint equivalent to the physical assumption of statically independent noise sources at each N location. An optimized noise source distribution is then generated over an identified aeroacoustic source region associated with the phased microphone array in order to compile an output presentation thereof, thereby removing the beamforming characteristics from the resulting output presentation.

20 Claims, 26 Drawing Sheets

1400

DECONVOLUTION METHODS AND SYSTEMS FOR THE MAPPING OF ACOUSTIC SOURCES FROM PHASED MICROPHONE ARRAYS

TECHNICAL FIELD

Embodiments are generally related to phased microphone arrays. Embodiments are also related to devices and components utilized in wind tunnel and aeroacoustic testing. Embodiments additionally relate to aeroacoustic tools utilized for airframe noise calculations. Embodiments also relate to any vehicle or equipment, either stationary or in motion, where noise location and intensity are desired to be determined.

BACKGROUND OF THE INVENTION

Wind tunnel tests can be conducted utilizing phased microphone arrays. A phased microphone array is typically configured as a group of microphones arranged in an optimized pattern. The signals from each microphone can be sampled and then processed in the frequency domain. The relative phase differences seen at each microphone determines where noise sources are located. The amplification capability of the array allows detection of noise sources well below the background noise level. This makes microphone arrays particularly useful for wind tunnel evaluations of airframe noise since, in most cases, the noise produced by wings, flaps, struts and landing gear models will be lower than that of the wind tunnel environment.

The use of phased arrays of microphones in the study of aeroacoustic sources has increased significantly in recent years, particularly since the mid 1990's. The popularity of phased arrays is due in large part to the apparent clarity of array-processed results, which can reveal noise source distributions associated with, for example, wind tunnel models and full-scale aircraft. Properly utilized, such arrays are powerful tools that can extract noise source radiation information in circumstances where other measurement techniques may fail. Presentations of array measurements of aeroacoustic noise sources, however, can lend themselves to a great deal of uncertainty during interpretation. Proper interpretation requires knowledge of the principles of phased arrays and processing methodology. Even then, because of the complexity, misinterpretations of actual source distributions (and subsequent misdirection of engineering efforts) are highly likely.

Prior to the mid 1980's, processing of array microphone signals as a result of aeroacoustic studies involved time delay shifting of signals and summing in order to strengthen contributions from, and thus "focus" on, chosen locations over surfaces or positions in the flow field. Over the years, with great advances in computers, this basic "delay and sum" processing approach has been replaced by "classical beamforming" approaches involving spectral processing to form cross spectral matrices (CSM) and phase shifting using increasingly large array element numbers. Such advances have greatly increased productivity and processing flexibility, but have not changed at all the interpretation complexity of the processed array results.

Some aeroacoustic testing has involved the goal of forming a quantitative definition of different airframe noise sources spectra and directivity. Such a goal has been achieved with arrays in a rather straight-forward manner for the localized intense source of flap edge noise. For precise source localization, however, Coherent Output Power (COP) methods can be utilized by incorporating unsteady surface pressure measurements along with the array. Quantitative measurements for distributed sources of slat noise have been achieved utilizing an array and specially tailored weighting functions that matched array beampatterns with knowledge of the line source type distribution for slat noise. Similar measurements for distributed trailing edge noise and leading edge noise (e.g., due in this case to grit boundary layer tripping) have been performed along with special COP methodologies involving microphone groups.

A number of efforts have been made at analyzing and developing more effective array processing methodologies in order to more readily extract source information. Several efforts include those that better account for array resolution, ray path coherence loss, and source distribution coherence and for test rig reflections. In a simulation study of methods for improving array output, particularly for suppressing side lobe contamination, several beamforming techniques have been examined, including a cross spectral matrix (CSM) element weighting approach, a robust adaptive beamforming, and a CLEAN algorithm. The CLEAN algorithm is a deconvolution technique that was first implemented in the context of radio astronomy.

The CSM weighting approach reduces side lobes compared to classical beamforming with some overall improvement in main beam pattern resolution. The results for the adaptive beam former, used with a specific constant added to the CSM matrix diagonal to avoid instability problems, have been encouraging. The CLEAN algorithm has been found to possess the best overall performance for the simulated beamforming exercise. The CLEAN algorithm has also been examined in association with a related algorithm referred to as RELAX, utilizing experimental array calibration data for a no-flow condition.

The result of such studies involves a mixed success in separating out sources. In other studies, using the same data, two robust adaptive beamforming methods have been examined and found to be capable of providing sharp beam widths and low side lobes. It should be mentioned that the above methods, although perhaps offering promise, have not produced quantitatively accurate source amplitudes and distributions for real test cases. In the CLEAN methodology in particular, questions have been raised with regard to the practicality of the algorithm for arrays in reflective wind tunnel environments.

A method that has shown promise with wind tunnel aeroacoustic data is the Spectral Estimation Method (SEM). SEM requires that the measured CSM of the array be compared to a simulated CSM constructed by defining distributions of compact patches of sources (i.e., or source areas) over a chosen aeroacoustic region of interest. The difference between the two CSM's can be minimized utilizing a Conjugate Gradient Method. The application of positivity constraints on the source solutions had been found to be difficult. The resultant source distributions for the airframe noise cases examined are regarded as being feasible and realistic, although not unique.

As a consequence of the drawbacks associated with the foregoing methods and approaches, an effort has been made to develop a complete deconvolution approach for the mapping of acoustic sources to demystify two-dimensional and three-dimensional array results, to reduce misinterpretation, and to more accurately quantify position and strength of aeroacoustic sources. Traditional presentations of array results involve mapping (e.g., contour plotting) of array output over spatial regions. These maps do not truly represent noise source distributions, but ones that are convolved with the array response functions, which depend on array geometry, size (i.e., with respect to source position and distributions), and frequency.

The deconvolution methodology described in greater detail herein therefore can employ these processed results (e.g., array output at grid points) over the survey regions and the associated array beamforming characteristics (i.e., relating the reciprocal influence of the different grid point locations) over the same regions where the array's outputs are measured. A linear system of "N" (i.e., number of grid points in region) equations and "N" unknowns is created. These equations are solved in a straight-forward iteration approach. The end result of this effort is a unique robust deconvolution approach designed to determine the "true" noise source distribution over an aeroacoustic source region to replace the "classical beam formed" distributions. Example applications include ideal point and line noise source cases, as well as conformation with well documented experimental airframe noise studies of wing trailing and leading edge noise, slat noise, and flap edge/flap cove noise.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for a method and system for mapping acoustic sources determined from microphone arrays.

It is another aspect of the present invention to provide for a "Deconvolution Approach for the Mapping of Acoustic Sources" (DAMAS) determined from phased microphone arrays.

It is yet a further aspect of the present invention to provide for improved devices and components utilized in wind tunnel and aeroacoustic testing.

It is also an aspect of the present invention to provide for aeroacoustic tools utilized for airframe noise calculations.

The aforementioned aspects and other objectives and advantages can now be achieved as described herein. A method and system for mapping acoustic sources determined from a phased microphone array, comprising a plurality of microphones arranged in an optimized grid pattern including a plurality of grid locations thereof. A linear configuration of N equations and N unknowns can be formed by accounting for a reciprocal influence of one or more beamforming characteristics thereof at varying grid locations among the plurality of grid locations. One or more full-rank equations among the linear configuration of N equations and N unknowns can then be iteratively determined. The full-rank can be attained by the solution requirement of the positivity constraint equivalent to the physical assumption of statically independent noise sources at each N location. An optimized noise source distribution is then generated over an identified aeroacoustic source region associated with the phased microphone array in order to compile an output presentation thereof, in response to iteratively determining at least one full-rank equation among the linear configuration of N equations and N unknowns, thereby removing the beamforming characteristics from the resulting output presentation.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

Figure 1:
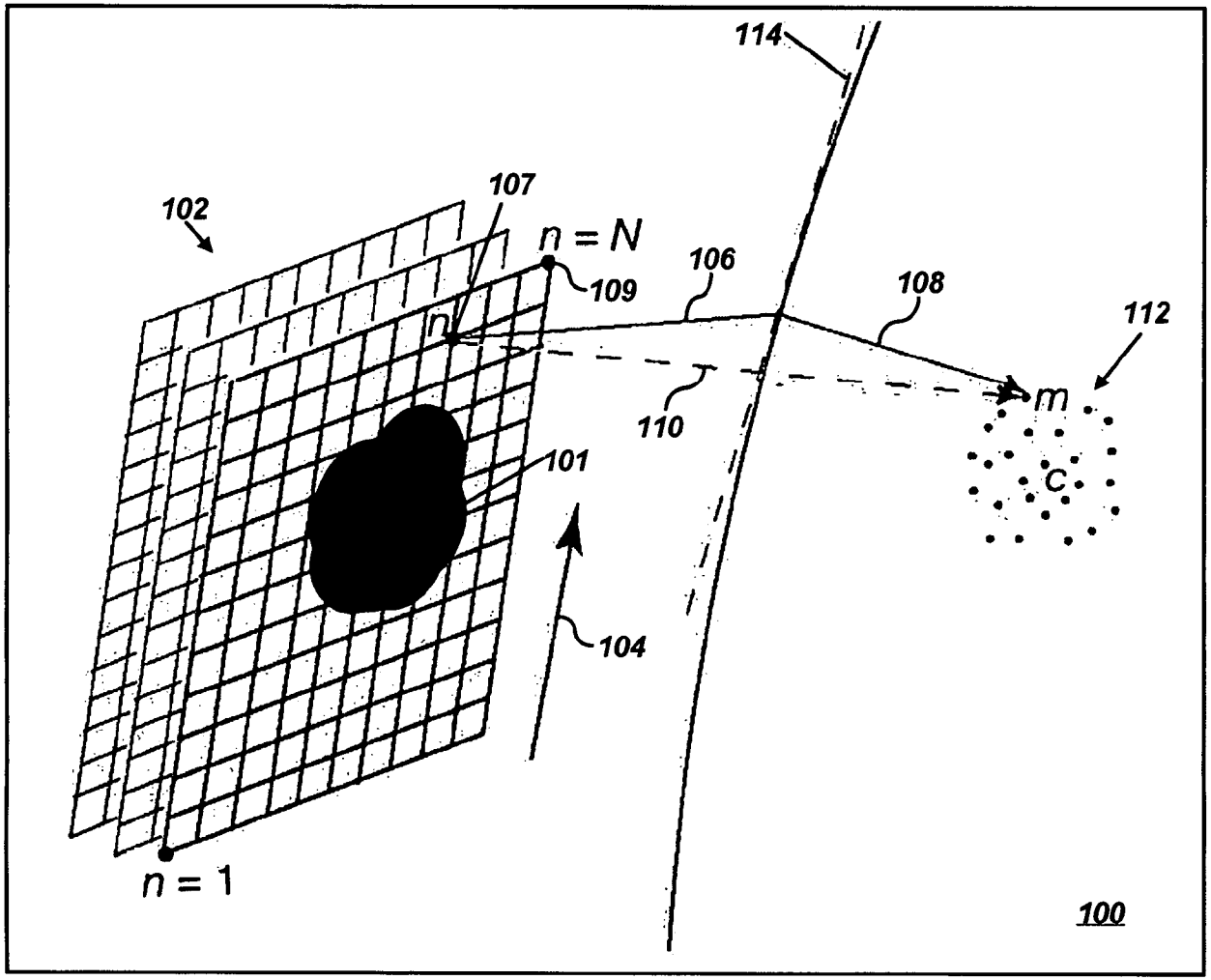
FIG. 1 illustrates an open jet configuration system wherein an array of microphones is indicated as out of flow and a scanning plane thereof positioned over an aeroacoustic source region, in accordance with one embodiment.

The particular values and configurations discussed in these non-limiting examples can be varied and are cited merely to illustrate at least one embodiment and are not intended to limit the scope thereof. Additionally, acronyms, symbols and subscripts utilized herein are summarized below.

Symbols and Acronyms $a_m$ shear layer refraction amplitude correction for $e_m$
A DAMAS matrix with $A_{nn'}$ components
$A_{nn'}$ reciprocal influence of beamforming characteristics between grid points
B array "beamwidth" of 3 dB down from beam peak maximum
$c_0$ speed of sound without mean flow
CSM cross spectral matrix
D nominal diameter of array
DR diagonal removal of $\hat{G}$ in array processing
$\hat{e}$ steering vector for array to focus location
$e_m$ component of $\hat{e}$ for microphone m
f frequency
$\Delta f$ frequency bandwidth resolution of spectra
FFT Fast Fourier Transform
$\phi$ array elevation angle
$G_{mm'}$ cross-spectrum between $p_m$ and $p_{m'}$
$\hat{G}$ matrix (CSM) of cross-spectrum elements $G_{mm'}$
H height of chosen scanning plane
i iteration number
k counting number of CSM averages, also acoustic wave number
l representative dimension of source geometry detail
LADA Large Aperture Directional Array
LE leading edge
m microphone identity number in array
m' same as m, but independently varied
$m_0$ total number of microphones in array
n grid point number on scanning plane(s)
M wind tunnel test Mach number
N total number of grid points over scanning plane(s)
$p_m$ pressure time records from microphone m
$P_m$ Fourier Transform of $p_m$
QFF Quiet Flow Facility
$Q_n$ idealized $P_m$ for modeled source at n for quiescent acoustic medium
$r_c$ distance $r_m$ for m being the center c microphone
$r_m$ retarded coordinate distance to m, $\tau_m c_0$
R nominal distance of array from scanning plane
SADA Small Aperture Directional Array
STD standard or classical array processing
T complex transpose (superscript)
TE trailing edge
$\tau_m$ propagation time from grid point to microphone m
$w_m$ frequency dependent shading (or weighting) for m
$\hat{W}$ shading matrix of $w_m$ terms
W width of scanning plane
$\Delta x$ widthwise spacing of grid points
$\hat{X}$ matrix of $X_n$ terms
$X_n$ "noise source" at grid point n with levels defined at array, $Q_n^*Q_n$
$\Delta y$ heightwise spacing of grid points
$Y(\hat{e})$ output power response of the array at focus location
$\hat{Y}$ matrix of $Y_n$ terms
$Y_n$ $Y(\hat{e})$, when focused at grid point n Subscripts bkg background
diag diagonal
m:n term associated with m, as it relates to grid position n
mod modeled The first step in a DAMAS formulation or analysis is to beamform over the source region, using what have become traditional methods. Post processing of simultaneously acquired data from the microphones of an array begins with computation of the cross-spectral matrix for each test case data set. The computation of each element of the matrix is performed using Fast Fourier Transforms (FFT) of the original data ensemble. The transform pairs $P_m(f,T)$ and $P_{m'}(f,T)$ are formed from pressure time records $p_m(t)$ and $p_{m'}(t)$, defined at discrete sampling times that are $\Delta t$ apart, of data block lengths T from microphones m and m', respectively. The cross-spectrum matrix element can be provided as indicated in equation (1) below:

$$G_{mm'}(f) = \frac{2}{Kw_sT}\sum_{k=1}^{K}[P^*_{mk}(f,T)P_{m'k}(f,T)] \tag{1}$$

This one-sided cross-spectrum can be averaged over K block averages. The total record length is $T_{tot}$=KT. The term $w_s$ represents a data-window (e.g., such as Hamming) weighting constant. $G_{mm'}(f)$ can be seen as a complex spectrum with values at discrete frequencies f, which are $\Delta f$ apart. The bandwidth is $\Delta f$=1/T (Hz). The full matrix is, with $m_0$ being the total number of microphones in the array, $$\hat{G} = \begin{bmatrix} G_{11} & G_{12} & \cdots & G_{1m_0} \\ \vdots & G_{22} & & \vdots \\ \vdots & & \iddots & \vdots \\ G_{m_01} & & & G_{m_0m_0} \end{bmatrix} \tag{2}$$

Note that the lower triangular elements are complex conjugates of the upper triangular elements. The cross-spectral matrix can be employed in conventional beamforming approaches to electronically "steer" to chosen noise source locations about an aeroacoustic test model.

FIG. 1 illustrates an open jet configuration system 100 wherein a phased microphone array 112 is indicated as out of flow and a scanning plane thereof positioned over an aeroacoustic source region, in accordance with one embodiment.

FIG. 1 generally depicts a particular test setup of a distribution of microphones of a phased array 112 located outside the flow field containing an aeroacoustic model. A scanning plane 102 of grid points can be defined over a noise source region 101. A tangent array crossing 114 is depicted in FIG. 1 between array 112 and the scanning plane 102. Air flow can be indicated by arrow 104 in FIG. 1. (A scanning plane may, for example, be placed through the chordline of an airfoil section when studying trailing edge and/or leading edge noise.) The beamforming approach involves steering vectors associated with each microphone with respect to a selected steering location. The steering location can be designated as grid point n, which is illustrated as point 107 in FIG. 1. At point 109, the value n is equal to the value N. The ray path indicating flow is generally represented by lines 106, 108 in FIG. 1, while the ray path for no flow indicated by line 110. The steering vector can be generally provided by equation (3) below:

$$\hat{e}=col[e_1 e_2 \ldots e_{m_0}] \tag{3}$$

where the component for each microphone m is $$e_m = a_m \frac{r_m}{r_c} \exp\{j2\pi f \tau_m\} \tag{4}$$

The vector components serve to phase shift each microphone signal to allow constructive summing of contributions from the chosen locations. $\tau_m$ is the time required to propagate from grid point n to microphone m. The phase can be designated as indicated in equation (5) below:

$$2\pi f \tau_m = (\vec{k} \cdot \vec{x}_m) + 2\pi f \Delta t_{m,shear} \tag{5}$$

The term $\vec{k}$ is the acoustic wave vector, $\vec{x}_m$ is the distance vector from the steering location to the microphone m. The steering vector components contain terms that account for the mean amplitude and phase changes due to convected and refracted sound transmission through the shear layer to each microphone. The corrections can be calculated through the use of Snell's law in Amiet's method, and adapted to a curved three-dimensional mean shear layer surface defined in the shear layer. Note that the variable $a_m$ represents the refraction amplitude correction.

The value $\Delta t_{m,shear}$ represents the additional time (compared to a direct ray path with no flow) it takes an acoustic ray to travel to microphone m from the steering location n, due to the convection by the open jet flow and refraction by the shear layer. As indicted by equation (4), the ratio $(r_m/r_C)$ can be included to normalize the distance related amplitude to that of the distance $r_C$ from the source location to the array center microphone at c. Both $r_m$ and $r_C$ are in terms of "retarded" coordinates. With this, $r_m=\tau_m c_0$, where $c_0$ equals the speed of sound without mean flow.

For classical or standard array beamforming, the output power spectrum (or response) of the array can be obtained utilizing equation (6) below:

$$Y(\hat{e}) = \frac{\hat{e}^T \hat{G} \hat{e}}{m_0^2} \tag{6}$$

where the superscript T denotes a complex transpose of the steering vector. Here the term $Y(\hat{e})$ can be a mean-pressure-squared per frequency bandwidth quantity. The division by the number of array microphones squared serves to reference levels to that of an equivalent single microphone measurement. Note that the cross-spectral matrix (CSM) $\hat{G}$ often has a corresponding background cross-spectral matrix $\hat{G}_{bkg}$ (i.e., obtained for a similar test condition except that the model is removed) subtracted from it to improve fidelity.

Shading algorithms can be used over distributions of array microphones to modify the output beampattern. The shaded steered response can be provided as indicated by equation (7) below:

$$Y(\hat{e}) = \frac{\hat{e}^T \hat{W} \hat{G} \hat{W}^T \hat{e}}{\left(\sum_{m=1}^{m_0} w_m\right)^2} \tag{7}$$

where $w_m$ represents the frequency dependent shading (or weighting) for each microphone m. The variable $\hat{W}$ represents a row matrix containing the $w_m$ terms. When all $w_m$ terms can be set to one and W becomes an identity matrix, all microphones are fully active in the beamforming to render the formulation of equation (6). Note that in some implementations, a special shading can be used to maintain constant beamwidth over a range of frequencies by shading out ($w_m$=0) inner microphone groups at low frequencies and by shading out outer groups at high frequencies.

A modified form of equation (6) can be used to improve the dynamic range of the array results in poor signal-to-noise test applications. The primary intent is to remove the microphone self noise contamination (i.e., particularly caused by turbulence interacting with the microphones). Such an action can be accomplished by removing (i.e., zeroing out) the diagonal terms of $\hat{G}$ and accounting for this change in the number of terms of $\hat{G}$ in the denominator. The output of Diagonal Removal (DR) processing can be provided equation (8) below:

$$Y(\hat{e}) = \frac{\hat{e}^T \hat{G}_{diag=0} \hat{e}}{m_0^2 - m_0} \tag{8}$$

This modifies the beamform patterns compared to equation (6). The diagonal can be viewed as expendable in the sense that it duplicates information contained in the cross terms of $\hat{G}$. However, great care must be taken in physical interpretation of resulting array response maps, for example, negative "pressure-squared" values are to be expected over low-level noise source regions. The corresponding shaded version of equation (8) can be provided as indicated by equation (9) below:

$$Y(\hat{e}) = \frac{\hat{e}^T \hat{W} \hat{G}_{diag=0} \hat{W}^T \hat{e}}{\left(\sum_{m=1}^{m_0} w_m\right)^2 - \left(\sum_{m=1}^{m_0} w_m\right)} \tag{9}$$

The common practice for studying aeroacoustic source of noise with arrays are to determine the array response, using either equations (6), (7), (8), or (9), over a range (grid) of steering locations about the source region. For particular frequencies, contours of the response levels are plotted over planes where sources are know to lie, or over volume regions in some cases. To extract quantitative contributions to the noise field from particular source locations, a number of methods are used. Integration methods can be utilized as well as special methods tailored to fit particular noise distributions, depending upon design considerations. Still the methods can be difficult to apply and care must be taken in interpretation. This is because the processing of equations (6)-(9) produces "source" maps which are as much a reflection of the array beamforming pattern characteristics as is the source distribution being measured.

The purpose here is to pose the array problem such that the desired quantities, the source strength distributions, are extracted cleanly from the beamforming array characteristics. First, the pressure transform $P_m$ of microphone m of equation (1) is related to a modeled source located at position n in the source field as indicated by equation (10) below:

$$P_{m:n}=Q_n e_{m:n}^{-1} \tag{10}$$

Here $Q_n$ represents the pressure transform that $P_{m:n}$ (or $P_m$) would be if flow convection and shear layer refraction did not affect transmission of the noise to microphone m, and if m were at a distance of $r_c$ from n rather than $r_m$. The $e_{m:n}^{-1}$ term represents simply those components that were postulated in equation (4) to affect the signal in the actual transmission to render the value $P_m$. The product of pressure-transform terms of equation (1) therefore becomes as indicated in equation (11) below:

$$\begin{aligned} P^*_{m:n}P_{m':n} &= (Q_n e^{-1}_{m:n})*(Q_n e^{-1}_{m':n}) \\ &= Q^*_n Q_n (e^{-1}_{m:n})*e^{-1}_{m':n} \end{aligned} \tag{11}$$

When this equation is substituted into equation (1), one obtains the modeled microphone array cross-spectral matrix for a single source located at n $$\hat{G}_{n_{mod}} = X_n \begin{bmatrix} (e_1^{-1})*e_1^{-1} & (e_1^{-1})*e_2^{-1} & \cdots & (e_1^{-1})*e_{m_0}^{-1} \\ (e_2^{-1})*e_1^{-1} & (e_2^{-1})*e_2^{-1} & & \vdots \\ & & \ddots & \vdots \\ & & & (e_{m_0}^{-1})*e_{m_0}^{-1} \end{bmatrix}_n \tag{12}$$

where $X_n$ is the mean square pressure per bandwidth at each microphone m normalized in level for a microphone at $r_m=r_c$. It is now assumed that there are a number N of statistically independent sources, each at different n positions. One obtains for the total modeled cross-spectral matrix $$\hat{G}_{mod} = \sum_n \hat{G}_{n_{mod}} \tag{13}$$

Employing this in equation (6), $$Y_{n_{mod}}(\hat{e}) = \left[\frac{\hat{e}^T \hat{G}_{mod}\hat{e}}{m_0^2}\right]_n \tag{14}$$

$$Y_{n_{mod}}(\hat{e}) = \frac{\hat{e}_n^T \sum_{n'} X_{n'}[\,]_{n'}\hat{e}_n}{m_0^2} = \sum_{n'} \frac{\hat{e}_n^T[\,]_{n'}\hat{e}_n}{m_0^2} X_{n'} \tag{15}$$

where the bracketed term is that of equation (12). This can be shown to equal $$Y_{n_{mod}}(\hat{e})=\hat{A}X_n \tag{16}$$

where the components of matrix $\hat{A}$ are $$A_{nn'} = \frac{\hat{e}_n^T[\,]_{n'}\hat{e}_n}{m_0^2} \tag{17}$$

By equating $Y_{n_{mod}}(\hat{e})$ with processed $Y(\hat{e})$ from measured data, we have $$\hat{A}\hat{X}=\hat{Y} \tag{18}$$

Equation (18), for $\hat{X}$, also applies for the cases of shaded standard, DR, and shaded DR beamforming, with components $A_{nn'}$ of $\hat{A}$ becoming $$A_{nn'} = \frac{\hat{e}^T\hat{W}[\,]_{n'}\hat{W}^T\hat{e}}{\left(\sum_{m=1}^{m_0} w_m\right)^2}, \tag{19}$$

$$A_{nn'} = \frac{\hat{e}_n^T([\,]_{n'})_{diag=0}\hat{e}_n}{m_0^2 - m_0}, \tag{20}$$

and $$A_{nn'} = \frac{\hat{e}_n^T\hat{W}([\,]_{n'})_{diag=0}\hat{W}^T\hat{e}_n}{\left(\sum_{m=1}^{m_0} w_m\right)^2 - \left(\sum_{m=1}^{m_0} w_m\right)^2} \tag{21}$$

respectively. For standard beamforming (shaded or not) the diagonal terms for $\hat{A}$ are equal to one. For Diagonal Removal beamforming (shaded or not), the diagonal terms for $\hat{A}$ are also equal to one, but the off-diagonal components differ and attain negative values when n and n' represent sufficiently distant points from one another, depending on frequency.

Equation (18) represents a system of linear equations relating a spatial field of point locations, with beamformed array-output responses $Y_n$, to equivalent source distributions $X_n$ at the same point locations. The same is true of equation (18) when $Y_n$ is the result of shaded and/or DR processing of the same acoustic field. $X_n$ is the same in both cases. (One is not restricted to these particular beamforming processing as long as $\hat{A}$ is appropriately defined.) Equation (18) with the appropriate $\hat{A}$ defines the DAMAS inverse problem. It is unique in that it or an equivalent equation must be the one utilized in order to disassociate the array itself from the sources being studied. Of course, the inverse problem must be solved in order to render $\hat{X}$. Equation (18) can therefore be thought of as constituting a DAMAS inverse formulation. Equations (22) to (24), on the other hand, which are describe in greater detail below, make solutions possible and thus function as a unique iterative method.

Equation (18) represents a system of linear equations. Matrix $\hat{A}$ is square (of size N×N) and if it were nonsingular (well-conditioned), the solution would simply be $\hat{X}=\hat{A}^{-1}\hat{Y}$. However, it has been found for the present acoustic problems of interest that only for overly restricted resolution (distance between n grid points) or noise region size (spatial expanse of the N grid points) would $\hat{A}$ be nonsingular. Using a Singular Value Decomposition (SVD) methodology for determining the condition of $\hat{A}$, it is found that for resolutions and region sizes of common interest in the noise source mapping problem in aeroacoustic testing that the rank of Â can be quite low—often on the order of 0.25 and below.

Rank here can be defined as the number of linearly independent equations compared to the number of equations of equation (18), which is N=number of grid points. This means that generally very large numbers of "solutions" are possible. Equation (18) and the knowledge of the difficulty with equation rank were determined early in the present study. The SVD solution approach with and without a regularization methodology special iterative solving methods such as Conjugate Gradient methods and others did not produce satisfactory results. Good results were ultimately obtained by a very simple tailored iterative method where a physically-necessary positivity constraint (making the problem deterministic) on the X components could be applied smoothly in the iteration. This is described below.

A single linear equation component of equation (18) is $$A_{n1}X_1+A_{n2}X_2+\ldots+A_{nn}X_n+\ldots+A_{nN}X_N=Y_n \tag{22}$$

With $A_{nn}=1$, this is rearranged to give $$X_n = Y_n - \left[\sum_{n'=1}^{n-1} A_{nn'} X_{n'} + \sum_{n'=n+1}^{N} A_{nn'} X_{n'}\right] \tag{23}$$

This equation is used in an iteration methodology to obtain the source distribution $X_n$ for all n between 1 and N as per the following equation.

$$\begin{aligned} X_1^{(i)} &= Y_1 - \left[0 + \sum_{n'=1+1}^{N} A_{1n'} X_{n'}^{(i-1)}\right] \\ X_1^{(i)} &= Y_n - \left[\sum_{n'=1}^{n-1} A_{nn'} X_{n'}^{(i)} + \sum_{n'=n+1}^{N} A_{nn'} X_{n'}^{(i-1)}\right] \\ X_N^{(i)} &= Y_N - \left[\sum_{n'=1}^{N-1} A_{Nn'} X_{n'}^{(i)} + 0\right] \end{aligned} \tag{24}$$

For the first iteration (i=1), the initial values $X_n$ can be taken as zero or $Y_n$ (the choice appears to cause little difference in convergence rates). It is seen that in the successive determination of $X_n$, for increasing n, the values are continuously fed into the succeeding $X_n$ calculations. After each $X_n$ determination, if it is negative, its value is set to zero. Each iteration (i) can be completed by like calculations, but reversed, moving from n=N back to n=1. The next iteration (i+1) starts again at n=1. Equation (24) is the DAMAS inverse problem iterative solution.

Figure 2:
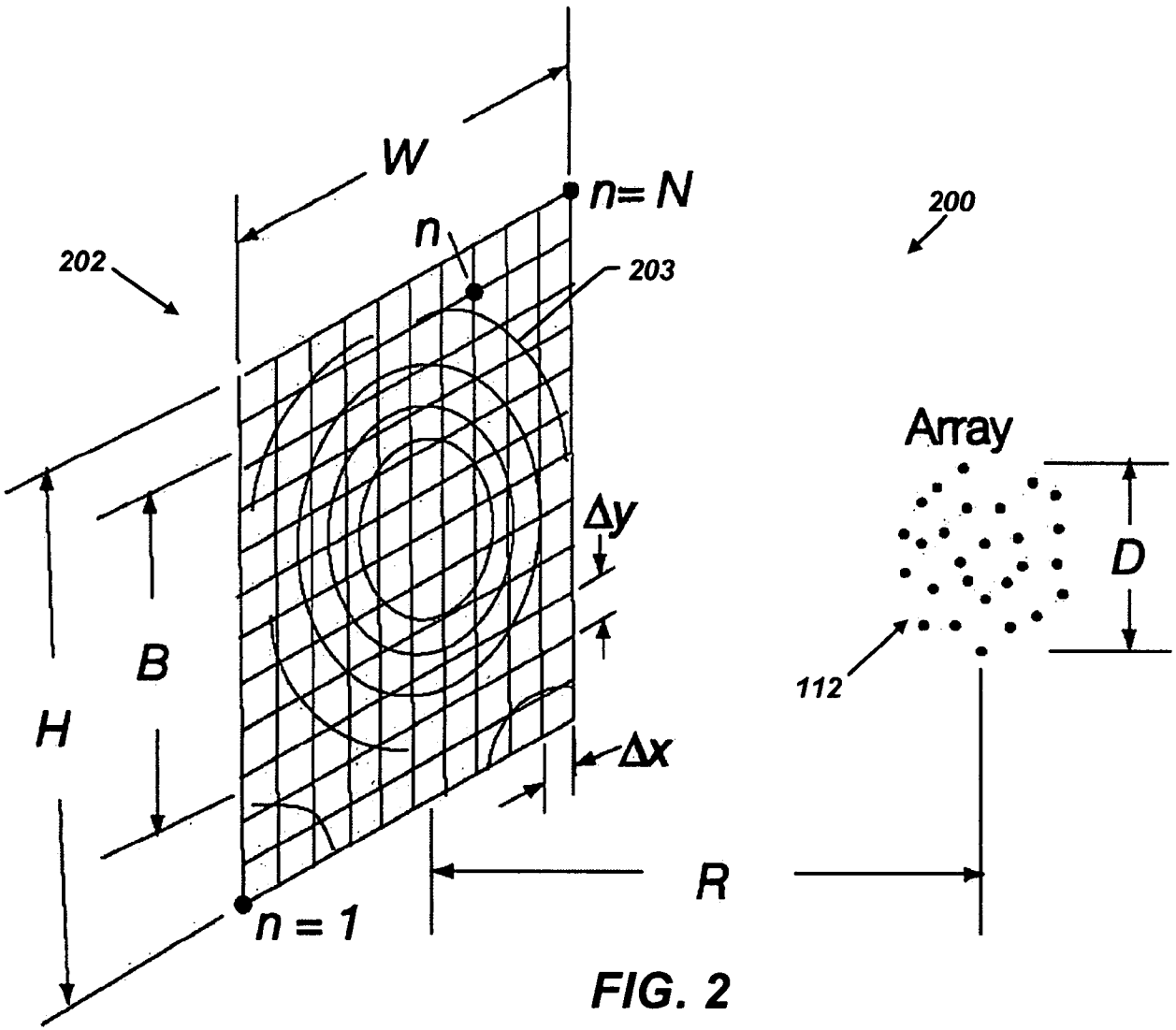
FIG. 2 illustrates a system including key geometric parameters of an array of microphones and a source scanning plane, in accordance with an embodiment.

FIG. 2 illustrates a system 200 including key geometric parameters of a phased microphone array 112 and a source scanning plane 202, in accordance with an embodiment. Note that the source scanning plane 202 depicted in FIG. 2 is generally analogous to the source scanning plane 102 depicted in FIG. 1. In general, FIG. 2 provides identified important parameters in defining the solution requirements for DAMAS for a scanning plane 102. The array has a spatial extent defined by the "diameter" D. It is at a nominal distance R from a scanning plane containing N grid points, which represent beamforming focal points, as well as the n locations of all the acoustic sources $X_n$ that influence the beamformed results $Y_n$. Note that in FIG. 2, circles 203 generally represent dB level contours over the grid(s) of the source scanning plane 202.

For a particular frequency, the array's beamformed output is shown projected on the plane as contour lines of constant output Y, in terms of dB. The scanning plane has a height of H and a width of W. The grid points are spaced Δx and Δy apart. Although not illustrated in FIG. 2, there are defined noise source sub-regions of size l within the scanning plane (subsets of $X_n$), where details are desired. This relates to source resolution requirements and is considered below. For the scanning plane, the total number of grid points, $$N=[(W/\Delta x)+1][(H/\Delta y)+1] \tag{25}$$

The array beamwidth B is defined as the "diameter" of the 3 dB-down output of the array compared to that at the beamformed maximum response. For standard beamforming of equation (6), $$B\approx \text{const}\times(R/fD) \tag{26}$$

For the SADA (Small Aperture Directional Array with a outer diameter of D=0.65 feet) in a traditional QFF configuration[1] with R=5 feet, the beamwidth is $B\approx(10^4/f)$ in feet for frequency f in Hertz. When using shading of equation (7), B is kept at about 1 ft. for 10 kHz≦f≦40 kHz.

In the applications of this report, some engineering choices are made with regard to what should represent meaningful solution requirements for DAMAS source definition calculations. Because the rank of matrix Â of equation (18) equals one when using the iterative solution equation (24), there is no definitive limitation on the spacing or number of grid points or iterations to be used. The parameter ratios Δx/B (and Δy/B) and W/B (and H/B) appear to be most important for establishing resolution and spatial extent requirements of the scanning plane.

The resolution Δx/B must be small or fine enough such that individual grid points along with other grid points represent a reasonable physical distribution of sources. However, too fine of a distribution would require substantial solution iterative times and then only give more detail than is realistically feasible, or believable, from a beampattern which is too broad. On the other hand, too coarse of a distribution would render solutions of X̂ which would reveal less detail than needed, and also which may be aliased (in analogy with FFT signal processing), with resulting false images.

The spatial extent ratio W/B (and H/B) must be large enough to allow discrimination of mutual influence between the grid points. Because the total variation of level over the distance B is only 3 dB, it appears reasonable to require that 1<W/B (and H/B). One could extend W/B (and H/B) substantially beyond one—such as to five or more. In the following simulations, resolution issues are examined for both a simple and a complicated noise source distribution. Two distributions types are considered because, as seen below with respect to l/B, source complexity affects source definition convergence. The simulations also serve as an introduction to the basic use of DAMAS.

Regarding execution efficiency of the DAMAS technique, it is noted that the per-iteration execution time of the methodology depends solely on the total number of grid points employed in the analysis and not on frequency-dependent parameters. In general, the iteration time can be expressed by time=$C(2N)^2i$, where C is a hardware-dependent constant. A representative execution time is 0.38 seconds/iteration running a 2601-point grid on a 2.8-GHz, Linux-based Pentium 4 machine using Intel Fortran to compile the code. For this study, a Beowulf cluster consisting of nine 2.8 GHz Pentium 4 machines was used to generate the figures shown subsequently. Note that in FIG. 2, the value B generally represents the diameter of three circles.

Figure 3:
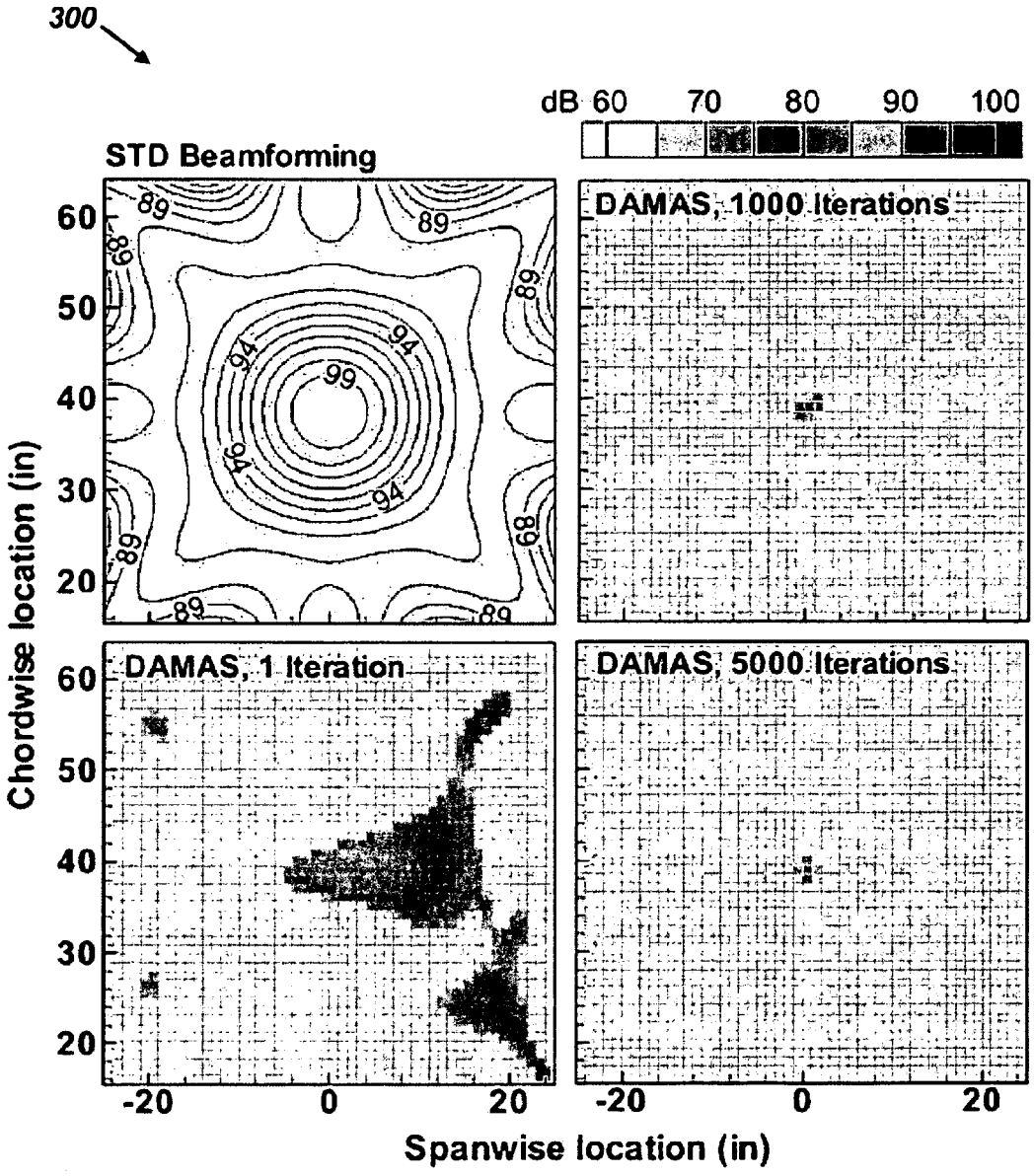
FIG. 3 illustrates a graphical representation of array output based on standard processing methodologies, wherein frequency is equal to 10 kHz and $\Delta x/B$ is generally equivalent to 0.083 in accordance with one embodiment.
Figure 4:
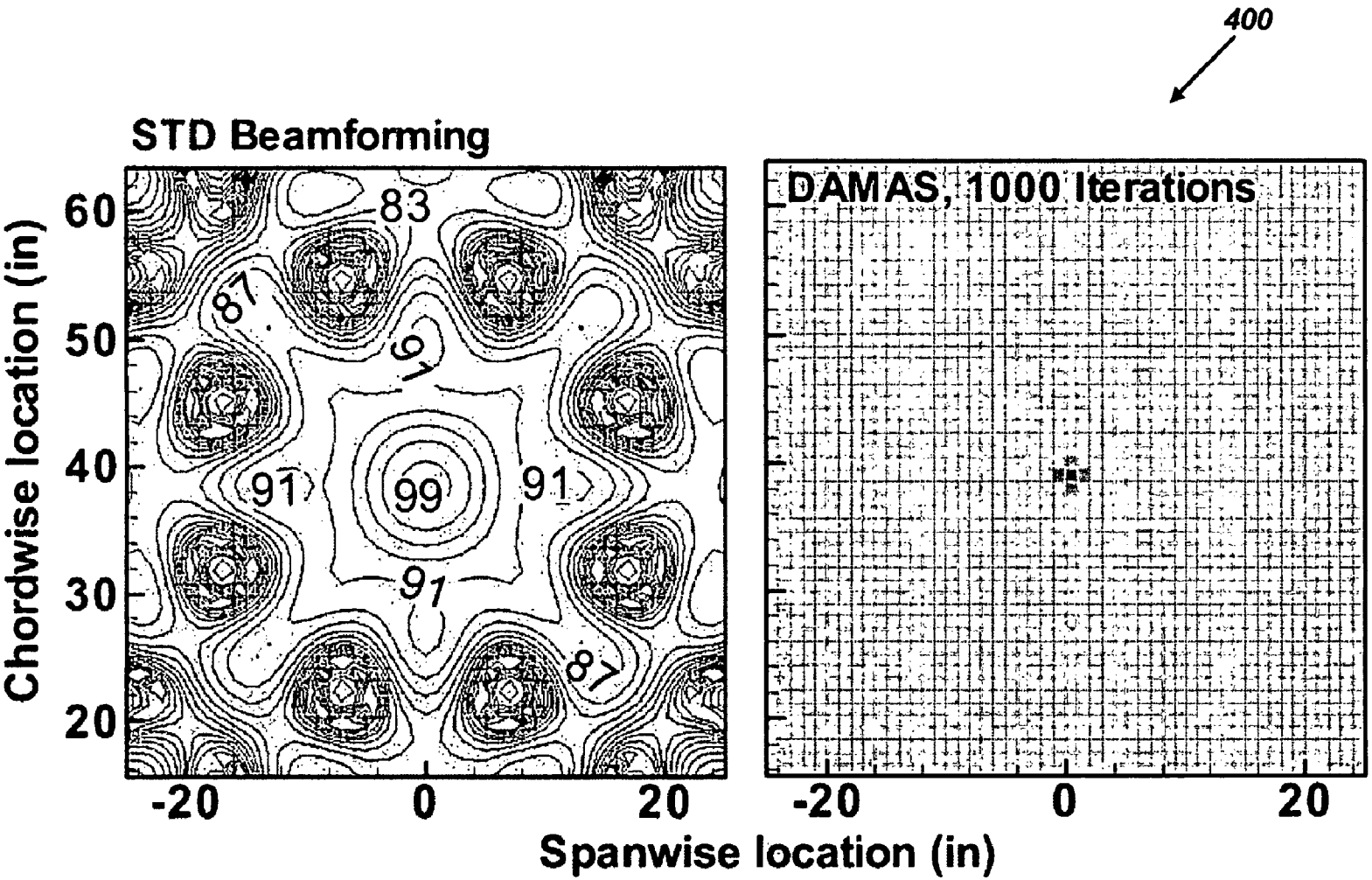
FIG. 4 illustrates a graphical representation of array output based on standard processing methodologies, wherein frequency is equal to 20 kHz and $\Delta x/B$ is generally equivalent to 0.167 in accordance with one embodiment.
Figure 5:
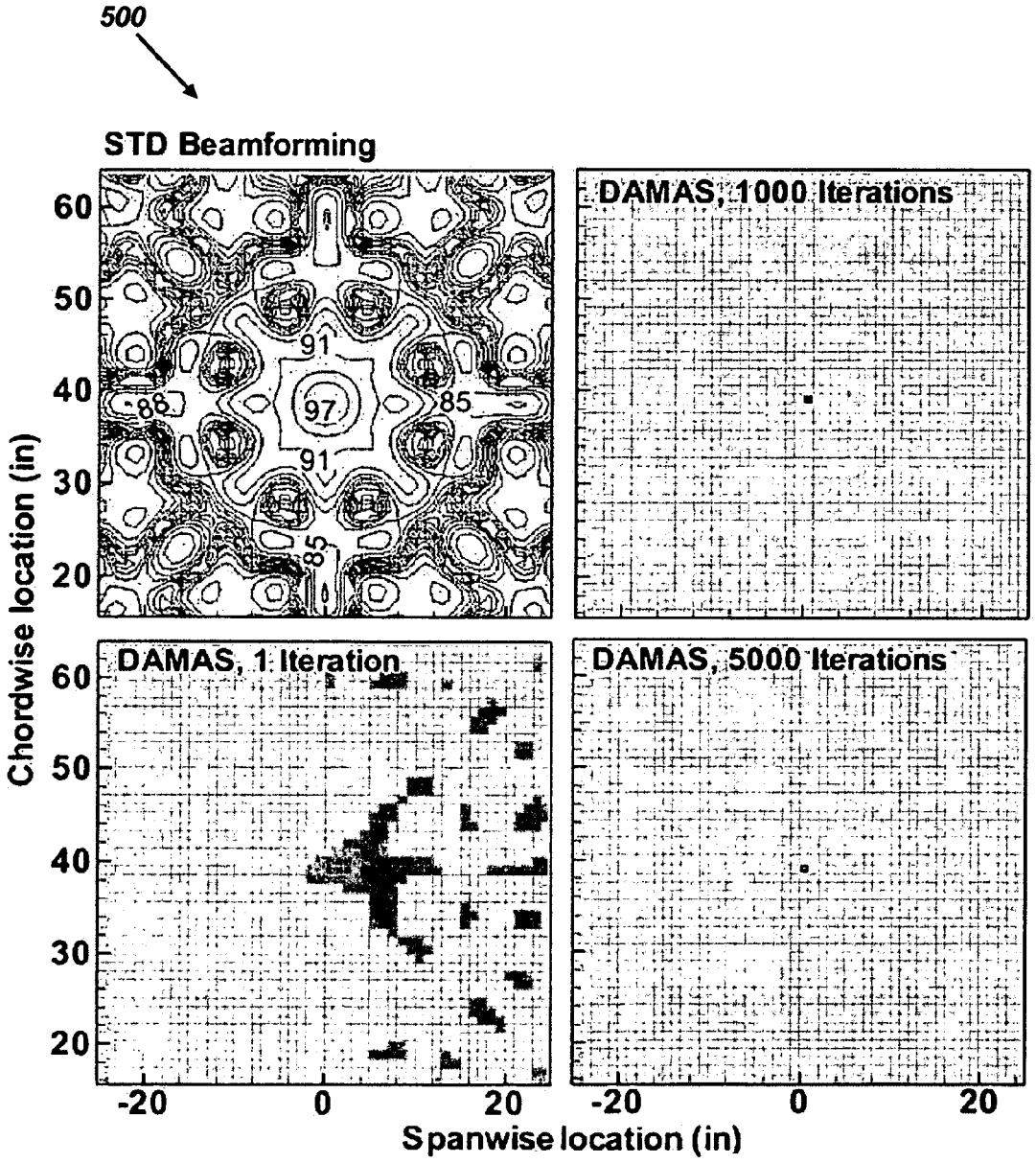
FIG. 5 illustrates a graphical representation of array output based on standard processing methodologies, wherein frequency is equal to 30 kHz and $\Delta x/B$ is generally equivalent to 0.25 in accordance with one embodiment.

FIG. 3 illustrates a graphical representation 300 of array output based on standard processing methodologies, wherein frequency is approximately equal to 10 kHz and Δx/B is generally equivalent to 0.083 in accordance with one embodiment. FIG. 4 illustrates a graphical representation 400 of array output based on standard processing methodologies, wherein frequency is equal to 20 kHz and Δx/B is generally equivalent to 0.167 in accordance with one embodiment. Likewise, FIG. 5 illustrates a graphical representation 500 of array output based on standard processing methodologies, wherein frequency is approximately equal to 30 kHz and Δx/B is generally equivalent to 0.25 in accordance with one embodiment;

In a traditional contour type presentation, the top left frame of the graphical representation of FIG. 3 illustrates an array output based on standard processing methodology of equation (6), being plotted in terms of constant dB contours over a scanning plane. In this simulation, the SADA is placed 5 feet from the plane that is positioned through a typical model location. In terms of the aforementioned parameters, H=W=50" and Δx=Δy=1". The resultant number of grid points is 2601 (underlying grid points are not shown in top left frame). With a chosen frequency of 10 kHz and the beamforming of equation (6), B≈12", so H/B=W/B=4.17 and Δx/B=0.083.

A single synthetic point source is placed at a grid point in the center of the plane, at n=1301. This is done by defining $X_{1301}$ to give 100 dB=10Log$X_{1301}$ and all other $\hat{X}$ values to zero in equation (18), and then solving for $\hat{Y}$. The values of dB=10Log$Y_n$ are then contour plotted. This, as with real array test data, is the starting point for the use of DAMAS. Equation (18) is solved for $\hat{X}$ using equation (17) for $A_{nn'}$, by way of equation (24), using $X_n=Y_n$ at the start of the iteration. The bottom left frame of the graphical representation 300 depicted in FIG. 3 illustrates the values of $X_n$ after one iteration (i=1). Rather than showing contours, the presentation is one of $X_n$ values in terms of dB at the grid points. Each grid point is actually located at the bottom left corner of the "blocks", each of dimension Δx=Δy=1".

In the top right and bottom right frames of graphical representation 300 the results after the one thousandth (i=1000) and the five thousandth (i=5000) iteration, respectively, are shown. At the highest iteration value, the original input value of 100 dB has been recovered within 0.1 dB and that the surrounding grid values over the plane are down in level by about 40 dB, except for the adjoining grid points at about 15-20 dB down. At the lesser iteration numbers, although there is some spreading of the source region, the integrated (obtained by simple summing of values over the spread region) levels are very close to 100 dB. One obtains 99.06 dB for 100 iteration (not shown in FIG. 3) and 100.03 dB for 1000 iterations.

The solution dependence on reducing the beamwidth B by a factor of two (Δx/B=0.167) is demonstrated in FIG. 4 where the frequency used is 20 kHz using the same standard processing over the same grid. The contour pattern is similar, but contracted, as shown in the left frame. The DAMAS result for 1000 iterations is given in the right frame. Comparing this to the results of FIG. 3, it is seen that here a more exact solution is attained with substantially less iterations. One obtains at peak of 99.97 dB, with all adjoining grid points lower by 27 dB.

Figure 6:
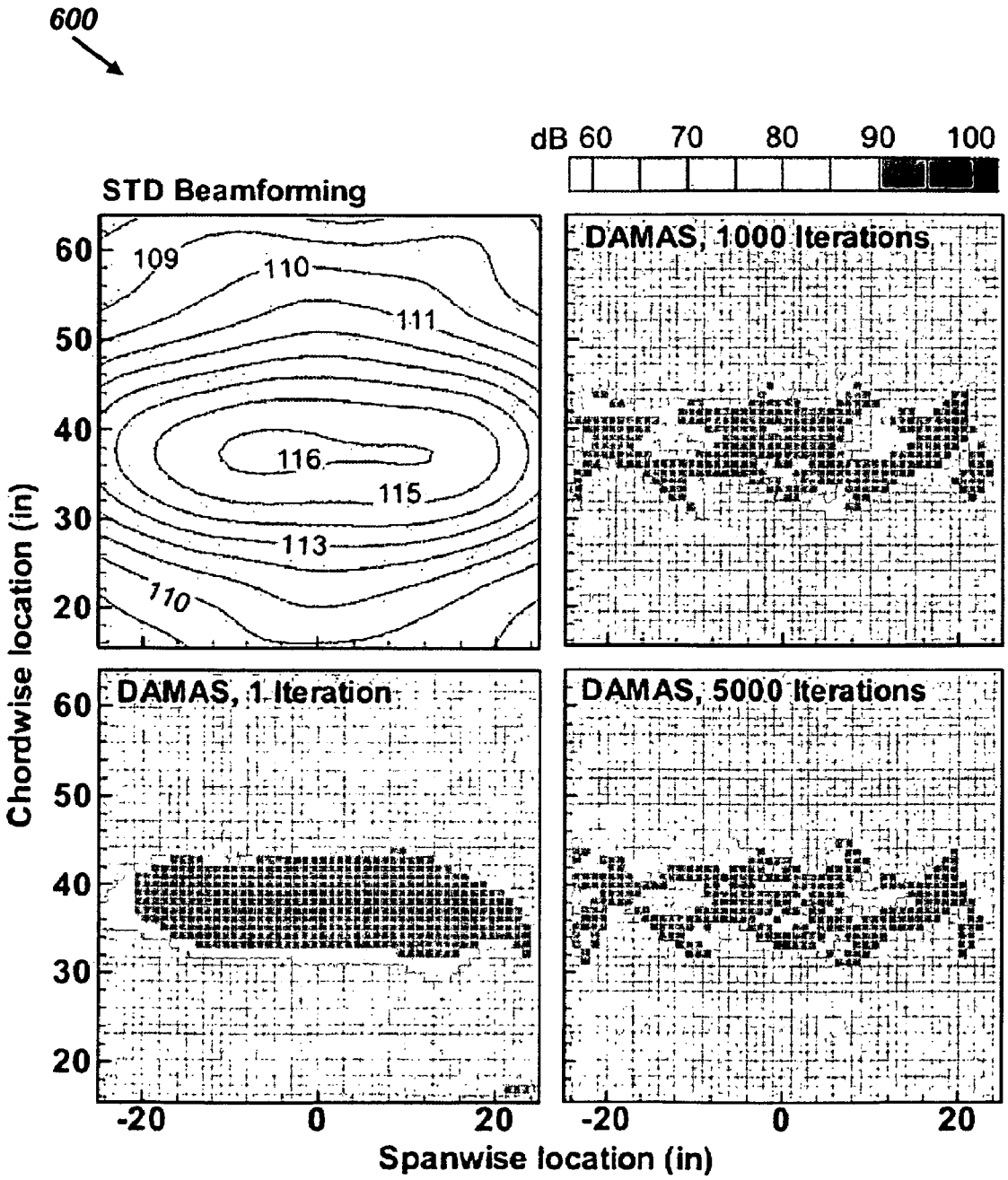
FIG. 6 illustrates a graphical representation of array output based on standard processing methodologies, wherein frequency is equal to 10 kHz and $\Delta x/B$ is generally equivalent to 0.083 in accordance with an alternative embodiment.
Figure 7:
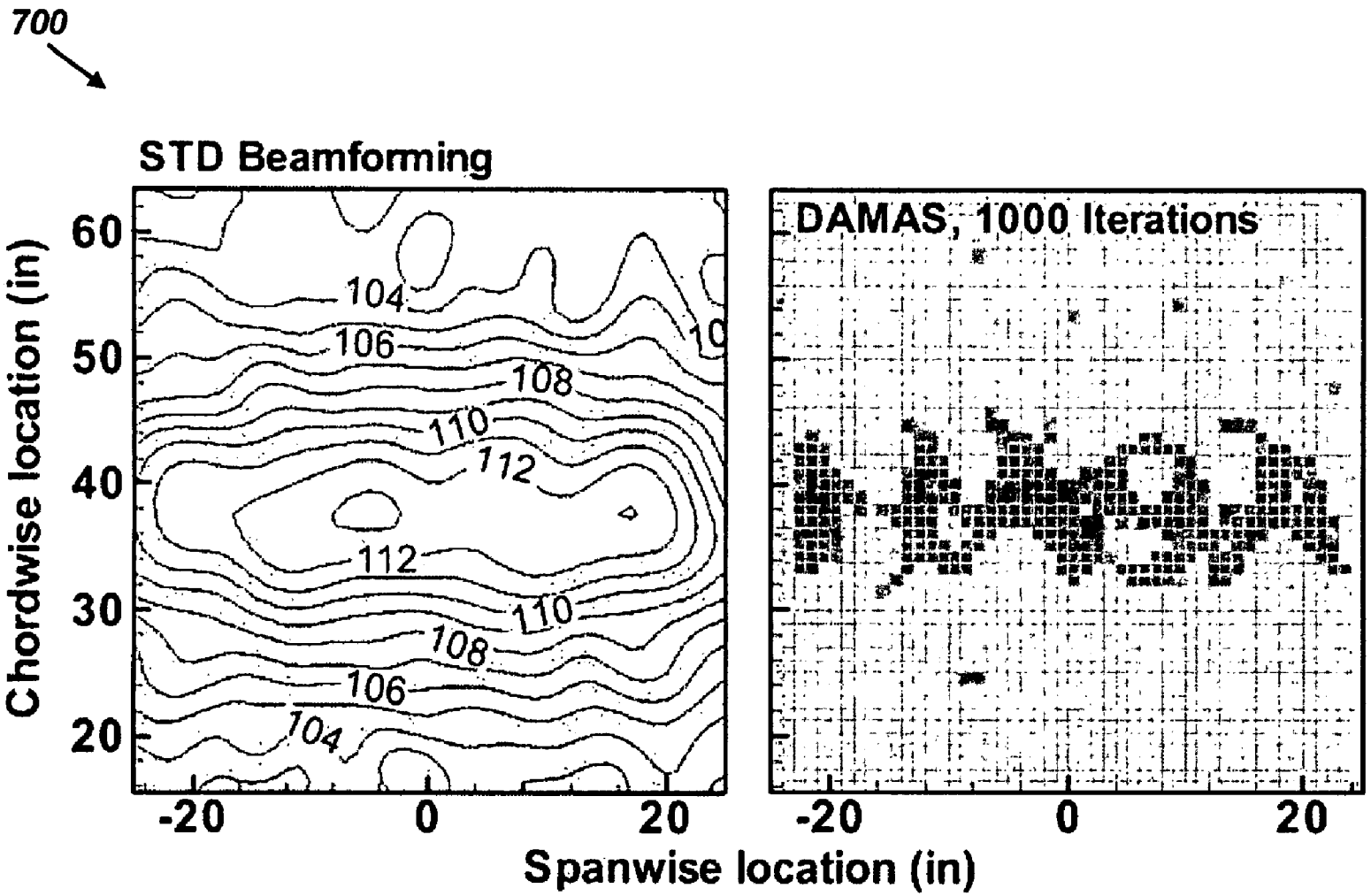
FIG. 7 illustrates a graphical representation of array output based on standard processing methodologies, wherein frequency is equal to 20 kHz and $\Delta x/B$ is generally equivalent to 0.167 in accordance with an alternative embodiment.
Figure 8:
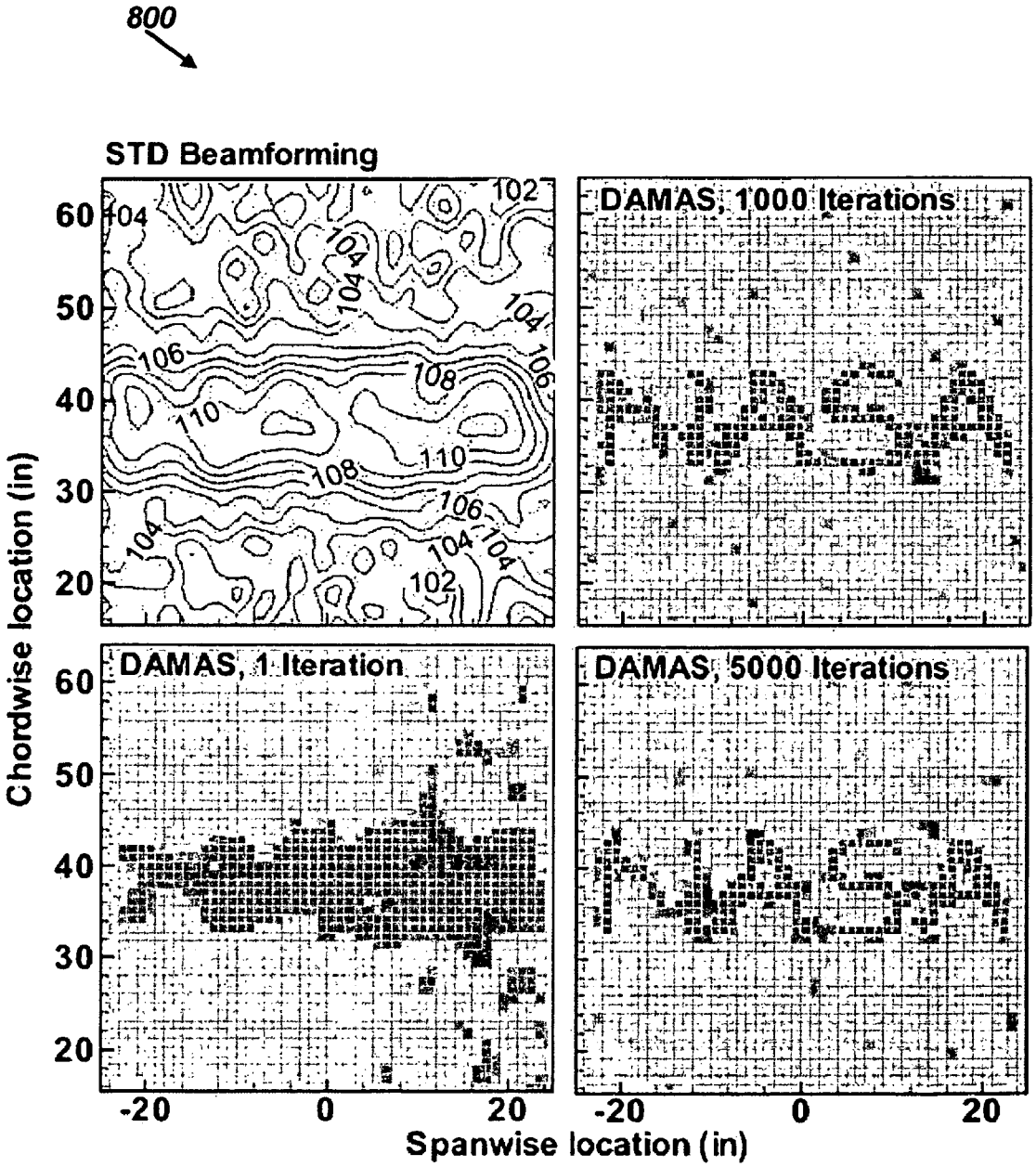
FIG. 8 illustrates a graphical representation of array output based on standard processing methodologies, wherein frequency is equal to 30 kHz and $\Delta x/B$ is generally equivalent to 0.25 in accordance with an alternative embodiment.
Figure 9:
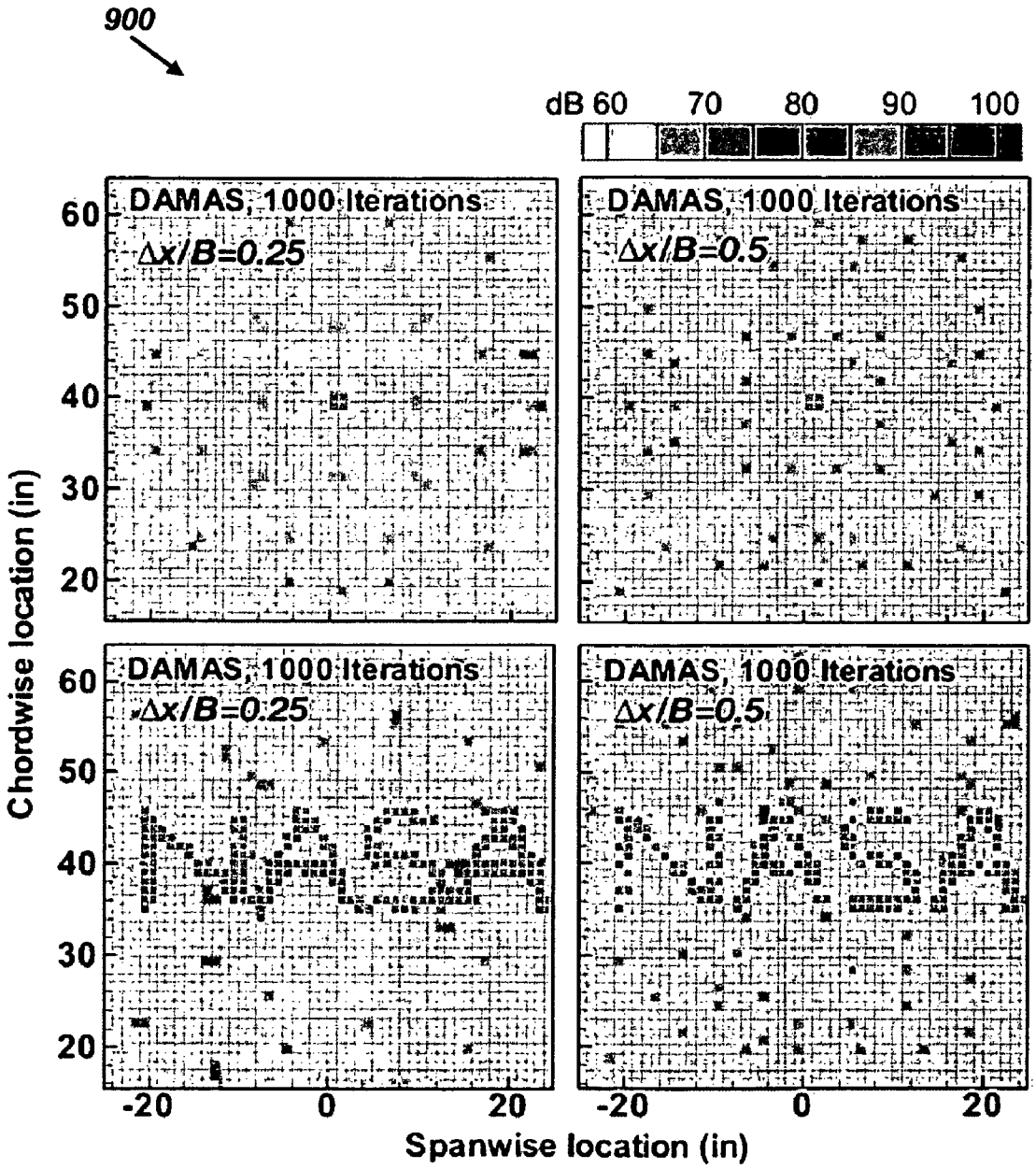
FIG. 9 illustrates a graphical representation of spatial aliasing with point source and image shifted between grid points in accordance with an alternative embodiment.

FIG. 6 illustrates a graphical representation 600 of an array output based on standard processing methodologies, wherein frequency is approximately equal to 10 kHz and Δx/B is generally equivalent to 0.083 in accordance with an alternative embodiment. Likewise, FIG. 7 illustrates a graphical representation 700 of array output based on standard processing methodologies, wherein frequency is approximately equal to 20 kHz and Δx/B is generally equivalent to 0.167 in accordance with an alternative embodiment. Additionally, FIG. 8 illustrates a graphical representation 800 of array output based on standard processing methodologies, wherein frequency is approximately equal to 30 kHz and Δx/B is generally equivalent to 0.25 in accordance with an alternative embodiment. FIG. 9 illustrates a graphical representation 900 of spatial aliasing with point source and image shifted between grid points in accordance with an alternative embodiment. FIG. 9 demonstrates the implementation of a DAMAS methodology with 1000 iterations.

The results of a more demanding simulation are depicted in FIGS. 6-8, where particular n locations were defined with same $X_n$ values (for 100 dB) and others zero. This gives a test of the solution procedure for a group of line source distributions. The important scanning plane parameters, including the number of solution iterations, given for FIGS. 6-8 are generally the same as above for FIGS. 2-5. In FIG. 6, for example, for Δx/B=0.083, the beamforming contour plot has an elongated appearance as one would expect to obtain for a line source. After using 5000 iterations, however, one begins to see structure other than a line source. Still, the image has not converged (i.e., although not shown, it starts to converges at higher iterations). In FIG. 7, for Δx/B=0.167, an image of very prominent character emerges at 1000 iterations (i.e., although not shown, even at only 100 iterations the image is recognizable). In FIG. 8, for Δx/B=0.25, all images are apparent. With regard to integrated power, it is found that when integrating (e.g., by summing grid point values), that the total noise from the image converges to the correct value rapidly with iterations.

Such simulations demonstrate that DAMAS successfully extracts detail noise source information from phased array beamformed outputs. It is seen that finer Δx/B resolutions require more iterations to get the same "accuracy." This becomes even more valid as the noise source region becomes more complicated. However, the number of iterations required should not be the major driving issue as the DAMAS methodology is proven to be efficient and robust. Also, it is found that all solutions, examined to date, improve with increasing iterations (i.e., using double precision computations). Caution is noted for potential error if Δx/B is made too large (e.g., Δx/B above 0.2 may be borderline) in real data cases where significant sources may be in-between chosen grid points. As previously mentioned for any such error, analogy can be made with the common data analysis subject of aliasing errors with respect to FFT sampling rates. No problems of this nature are possible in these simulations because the sources are collocated at the grid points.

Experimental applications have been implemented to demonstrate the DAMAS methodology described herein. For example, experimental data from several airframe component noise studies can be re-examined with DAMAS. In such applications, DAMAS is not used with necessarily optimum resolution and scanning plane size. However, all cases fall at or near an acceptable range of 0.05≦Δx/B (i.e., and Δy/B)≦0.2. For consistency with the simulations, (except for the calibrator case) the same scanning plane and resolution sizes are used with the same resultant number of grid points. The number of iterations used for all is 1000. In contrast with the simulations, the experimental results are presented in terms of one-third octave values, for the array using several different array beamforming methodologies, in order to compare to the results of the previous studies.

Figure 10:
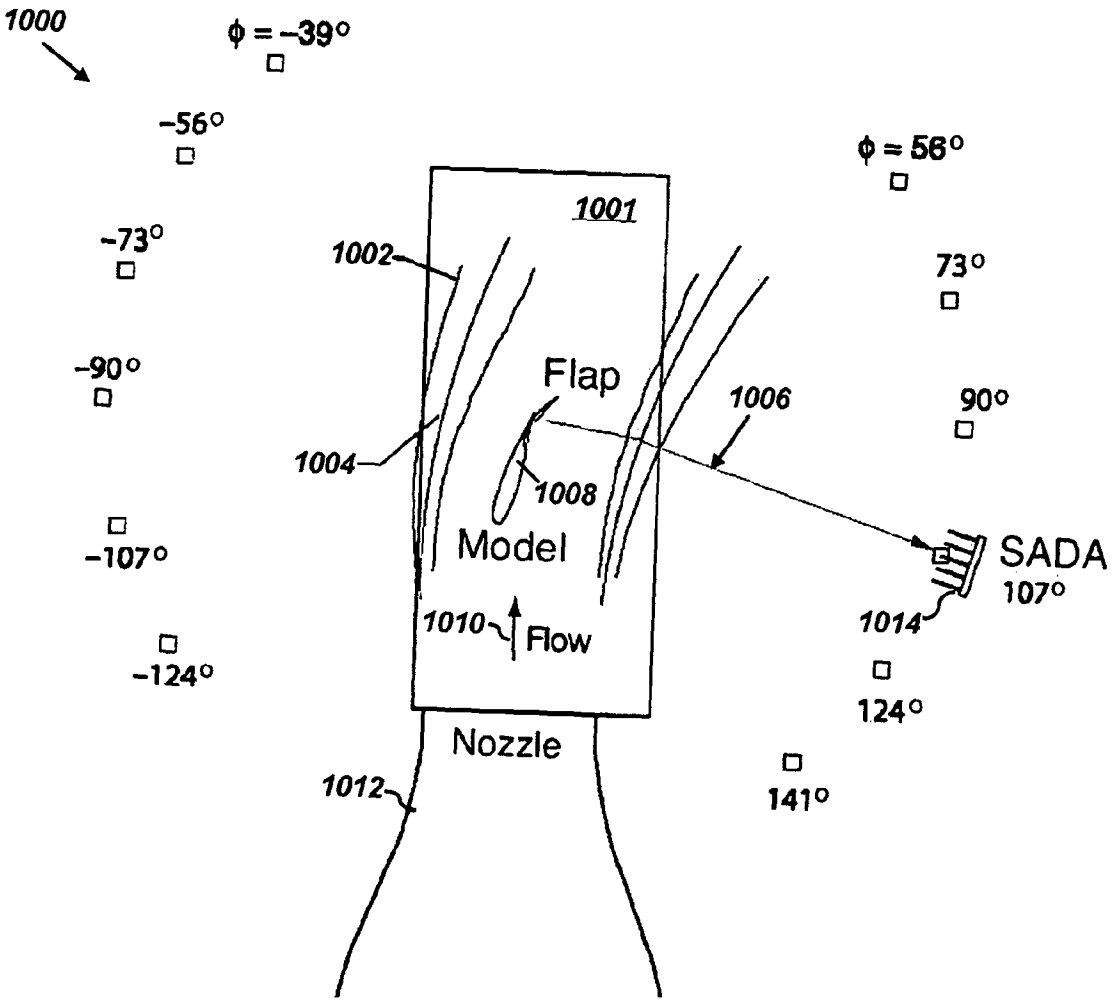
FIG. 10 illustrates a configuration of a noise flap from a flap edge to an SADA, in accordance with an alternative embodiment.
Figure 11:
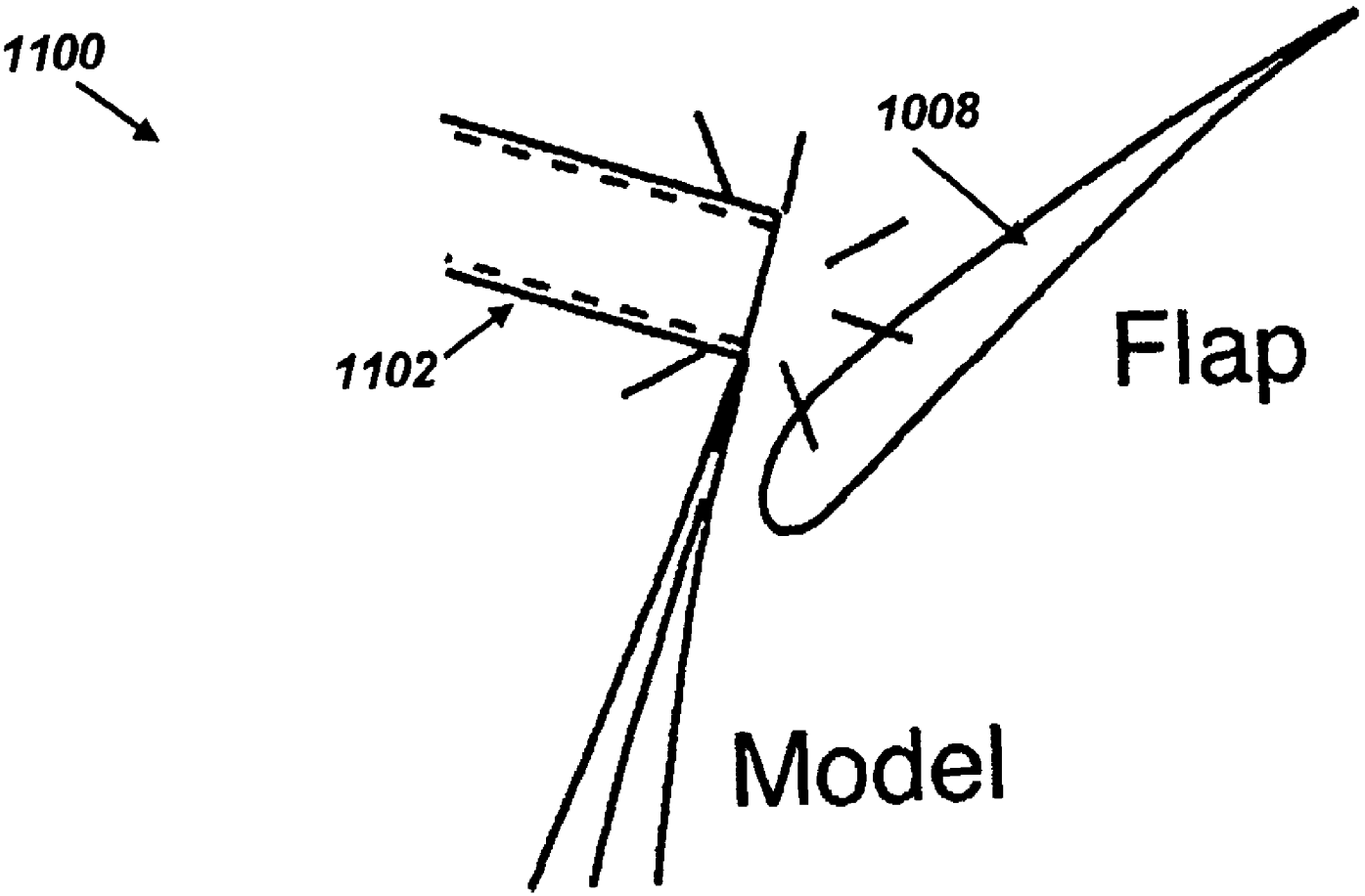
FIG. 11 illustrates an open end of a calibrator source positioned next to the flap edge depicted in FIG. 10, in accordance with an alternative embodiment.

FIGS. 10 and 11 respectively illustrate configurations 1000 and 1100 of a test set up for flap edge noise test and calibration. In configuration 1000 of FIG. 10, for example, the noise path from the flap edge to a SADA device 1014 is illustrated as represented by ray path 1006. A mean shear layer 1004 is depicted in FIG. 10 in association with a shear layer 1002. Arrow 1010 depicted in FIG. 10 represents airflow from a nozzle 1012. A flap model 1008 is also depicted in FIG. 10. The nozzle 1012 is located adjacent to and/or integrated with a side plate 1001.

In configuration 1000 of FIG. 11, on the other hand, the open end of a calibrator source is depicted positioned next to the edge of flap 1008. Note that in FIGS. 10-11, identical or similar parts or elements are generally indicated by identical reference numerals. Thus, FIGS. 10-11 should be interpreted together. A sketch of the flap edge noise experimental setup is therefore depicted in configuration 1000 of FIG. 10, wherein an airfoil main element is located at a 16° angle-of-attack to the vertical plane. The SADA device 1014 is shown positioned out of or away from the flow represented by arrow 1010 in FIG. 10. For configuration 1000 depicted in FIG. 10, the calibration test can be performed using a noise source, comprised of an open end of a one-inch diameter tube, placed next to the flap edge, as depicted in configuration 1100 of FIG. 11. Note that in the configuration illustrated in FIG. 11, a calibration source 1102 is shown proximate to the flap 1008.

Figure 12:
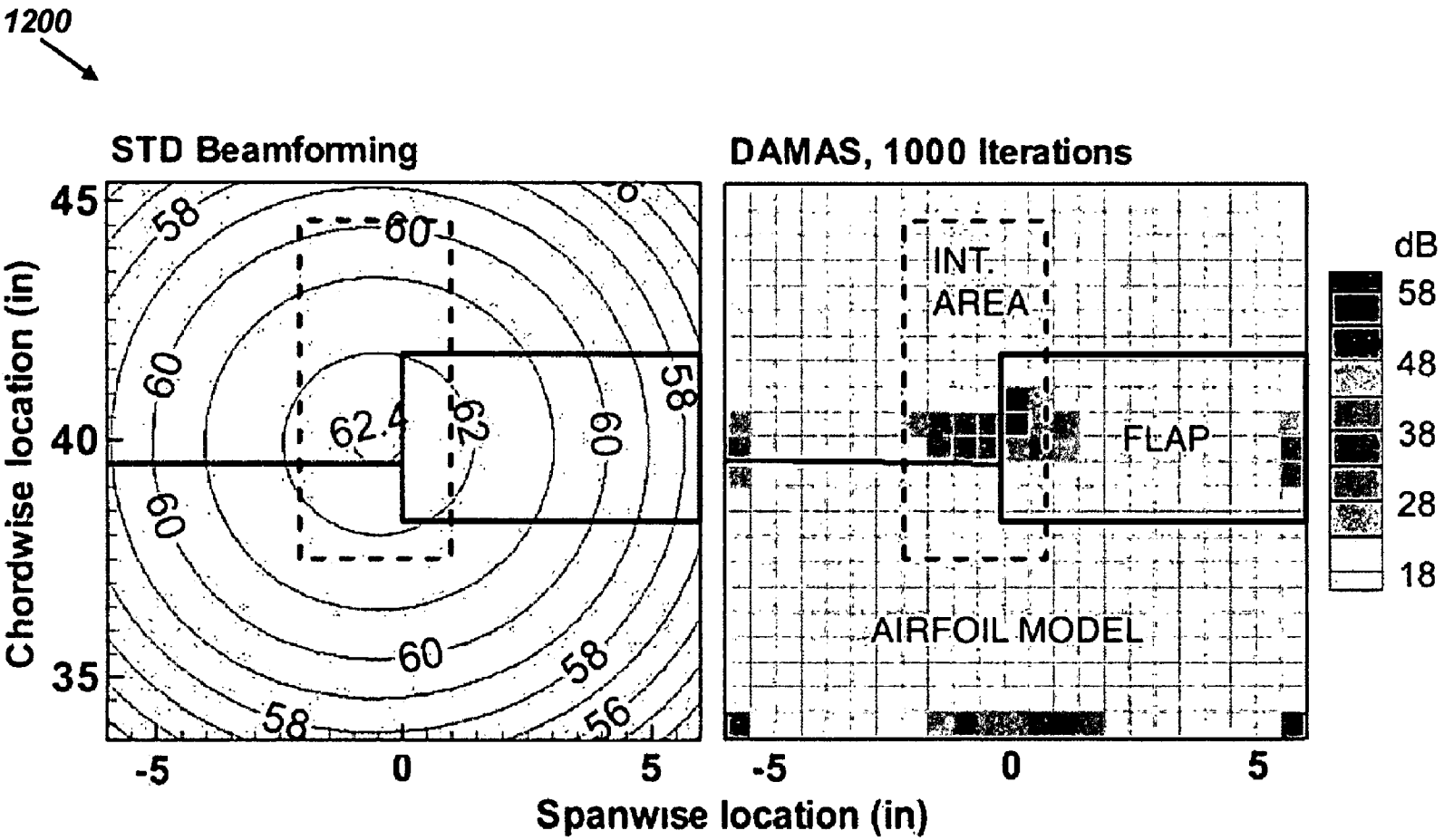
FIG. 12 illustrates a graphical representation of calibrator source test data wherein M=0 with an integrated level of 62.8 dB and a DAMAS of 62.9 dB, in accordance with an alternative embodiment.
Figure 13:
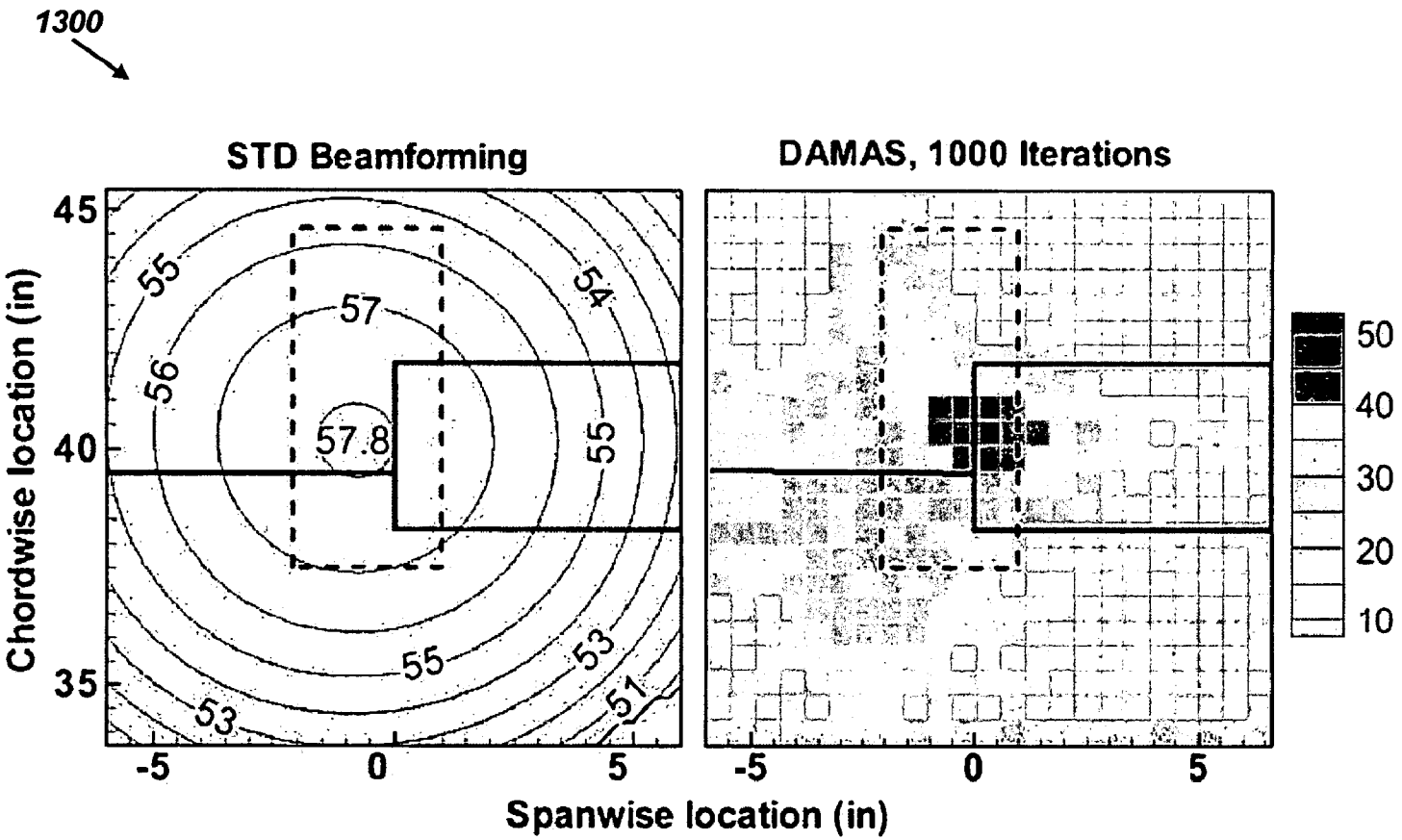
FIG. 13 illustrates a graphical representation of calibrator source test data wherein M=0.17, with an integrated level of 58.1 dB and a DAMAS of 57.3 dB, in accordance with an alternative embodiment.
Figure 14:
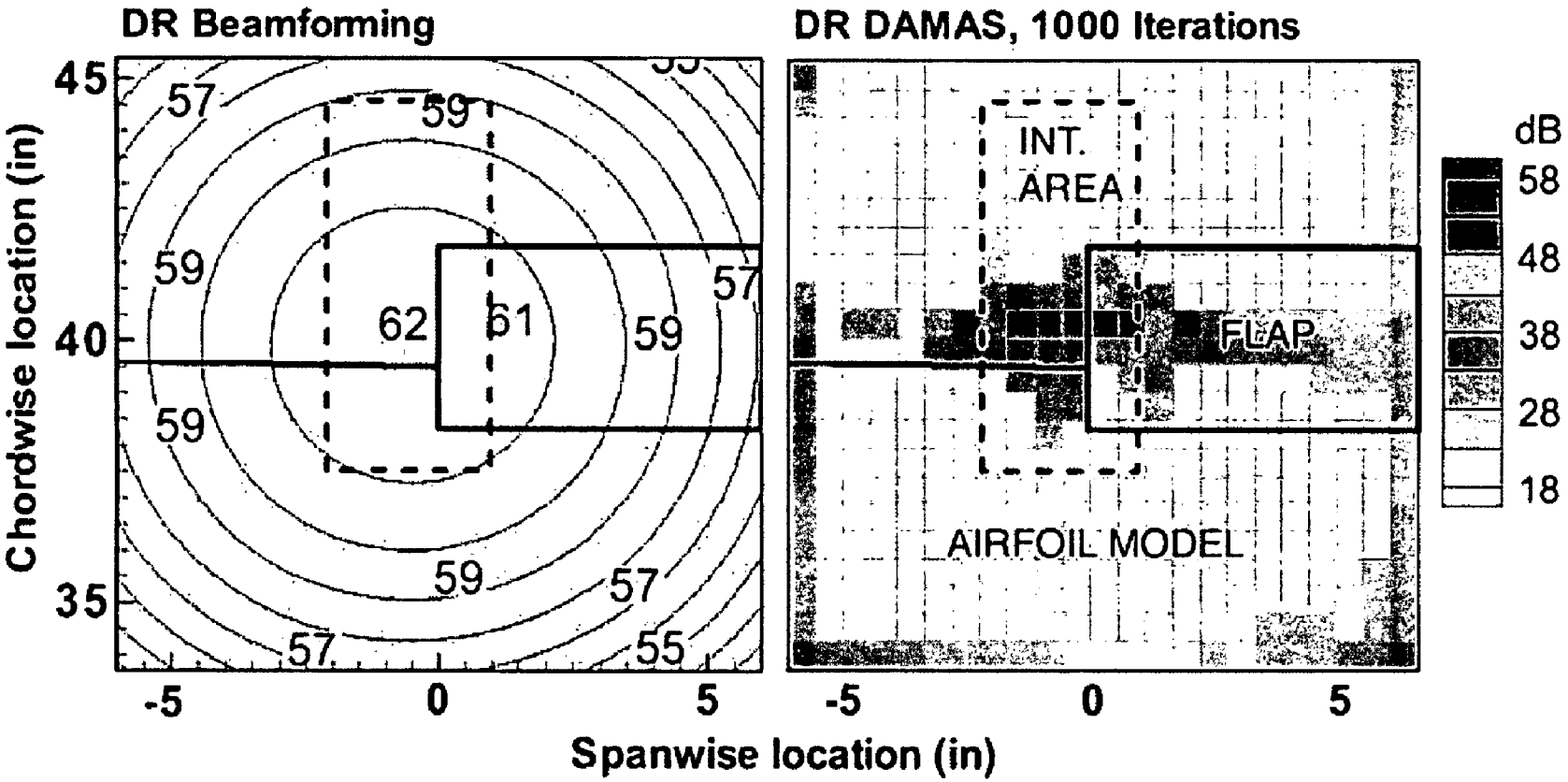
FIG. 14 illustrates a graphical representation of a calibrator source test, wherein M=0 with an integrated level of 62.2 dB and a DAMAS of 61.6 dB, in accordance with an alternative embodiment.
Figure 15:
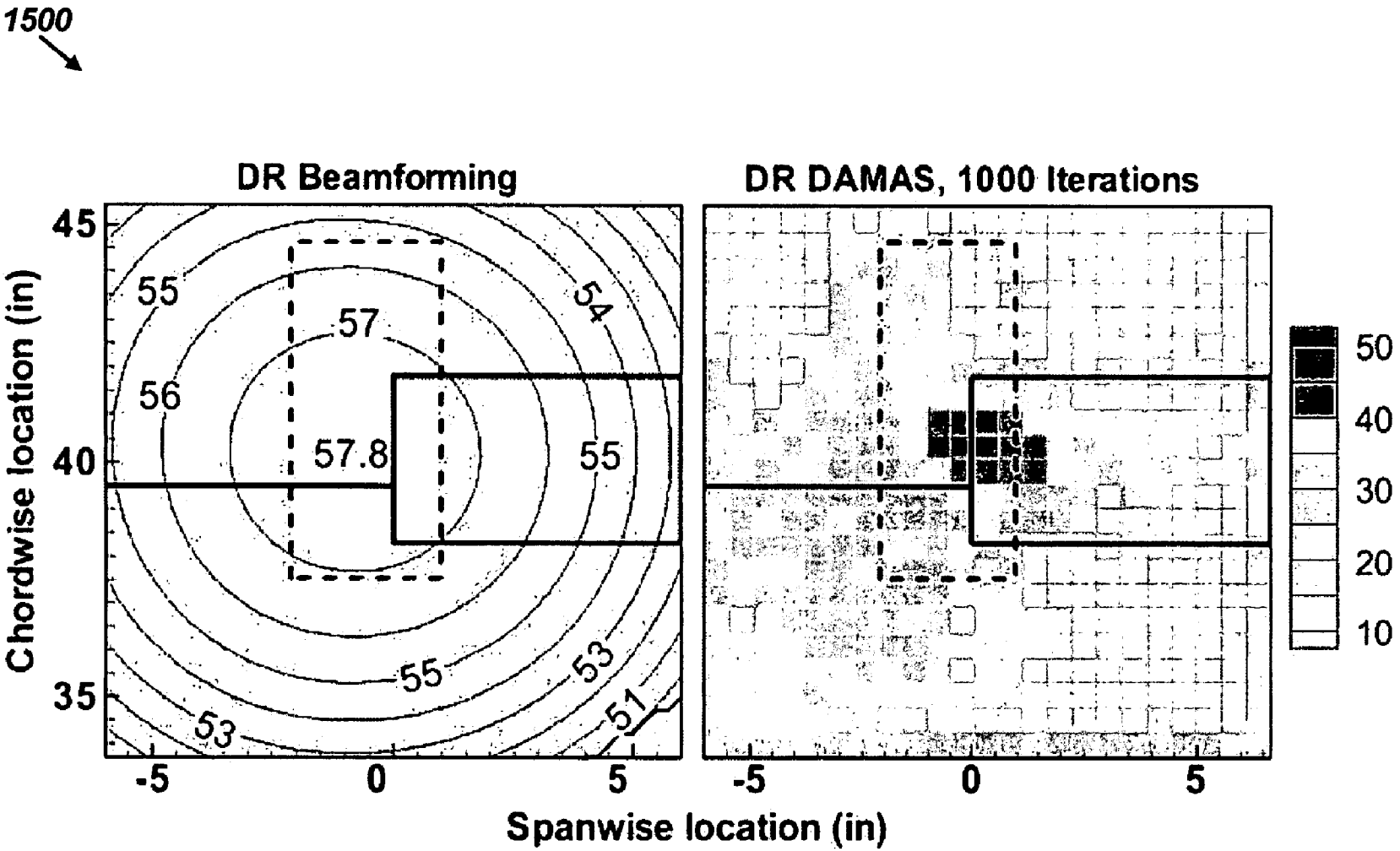
FIG. 15 illustrates a graphical representation of a calibrator source test, wherein M=0.17 with an integrated level of 57.9 dB and a DAMAS of 56.9, in accordance with an alternative embodiment.

FIG. 12 illustrates a graphical representation 1200 of calibrator source test data wherein M=0 with an integrated level of 62.8 dB and a DAMAS of 62.9 dB, in accordance with an alternative embodiment. Similarly, FIG. 13 illustrates a graphical representation 1300 of calibrator source test data wherein M=0.17, with an integrated level of 58.1 dB and a DAMAS of 57.3 dB, in accordance with an alternative embodiment. FIG. 14 illustrates a graphical representation 1400 of a calibrator source test, wherein M=0 with an integrated level of 62.2 dB and a DAMAS of 61.6 dB, in accordance with an alternative embodiment. FIG. 15 illustrates a graphical representation 1500 of a calibrator source test, wherein M=0.17 with an integrated level of 57.9 dB and a DAMAS of 56.9, in accordance with an alternative embodiment;

FIGS. 12 and 13 respectively illustrate DAMAS results from an experimental implementation thereof. For the calibrator source operating with no tunnel flow M=0, FIG. 12 shows SADA response contours for standard (STD) processing with shading, equation (7), over a scanning plane positioned through the airfoil chord-line. This is a one-third octave presentation for 10LogY for $f_{1/3}$=40 kHz. The result was obtained by performing and summing 546 single-frequency beamforming maps (each with frequency resolution bandwidth of Δf=17.44 Hz). Note that with this array-shading, only the inner SADA diameter of 1.95 inches is active. For this no-flow case, the convective and shear layer refraction terms are absent in the steering vector definition, equations (4) and (5).

The right frame of FIG. 12 illustrates the result for the rendered source X distribution when DAMAS is applied, solving equation (18), and using equation (19), by way of equation (24). The scanning plane used is H=W=12". Consistent with the contour presentation, the DAMAS result is a one third octave presentation obtained by separately solving for the 546 separate bands and then summing. With B=12" and a chosen Δx=Δy=0.55", one has a resolution of Δx/B=0.046 (which is close to the recommended lower limit of 0.05). The number of grid points is 441 and the number of iterations used is 1000 for each frequency.

Note that a characteristic of the DAMAS solution is the non-negligible amplitudes distributed at grid points around the border of the scanning planes in FIG. 13. This is a scanning plane "edge" effect that is found to occur only for experimental data, where noise in the scanning plane is influenced to some degree by sources outside (or extraneous to) the plane. DAMAS constructs noise distribution solutions on the scanning plane grid points totally based on whatever is measured by beamforming on those grid points. The edge effect was examined by expanding the scanning plane to eliminate any edge problem in the region of interest. A result almost identical to FIG. 12 was found over regions other than at the edge. Thus the edge effect has negligible impact on these results. This subject is dealt with subsequently for other applications.

A small rectangular integration region, illustrated by dashed lines in FIG. 12, can be used to calculate an integrated value of 62.8 dB. Correspondingly, for the present DAMAS result, one simply adds the pressure-squared values of the grid points within the source region. One obtains a value of 62.9 dB. FIG. 13 illustrates the SADA response contour for the tunnel flow at M=0.17. Here, the convective and shear layer refraction terms are important in the steering vector definition. The integrated value from Ref. 1 is 58.1 dB, whereas the DAMAS value is 57.3 dB. It is seen by comparing the somewhat smeared image of FIGS. 12-13 that the affect of the tunnel flow and the resultant turbulent shear layer is to spread the apparent noise region. The DAMAS result in FIG. 13 is of particular interest because, to the knowledge of the authors, it may be the first direct measure of spatial dispersion of noise due to turbulence scatter.

For the same test cases as FIGS. 12-13. 7, FIGS. 14-15 illustrate results when diagonal removal (DR), equation (9), is employed in the beamforming. Correspondingly, DAMAS is applied using equation (21) for $A_{mn'}$. It is seen that although the DR processing modifies the Y distributions, the X source distributions and values are calculated to be almost identical to those of FIGS. 12-13. DR processing has the advantage of removing the auto-spectra (and possible microphone noise contamination) from the processing, while still maintaining full rank for the solution equations.

Although it is beyond the scope of this paper to evaluate the use of DAMAS for different array designs than the SADA, a limited application using Large Aperture Directional Array (LADA) data produced good comparisons for a case corresponding to a frame of FIG. 12. The LADA has an outer diameter of D=2.83 feet, which is 4.35 times the size of SADA (i.e., 17.4 times the active diameter of the SADA at 40 kHz for shaded processing). For a similar calibration test to that of FIG. 12 but for array processing without shading, the integrated LADA value is 60.3 dB, and the corresponding DAMAS summed value is 61.4 dB.

Figure 16:
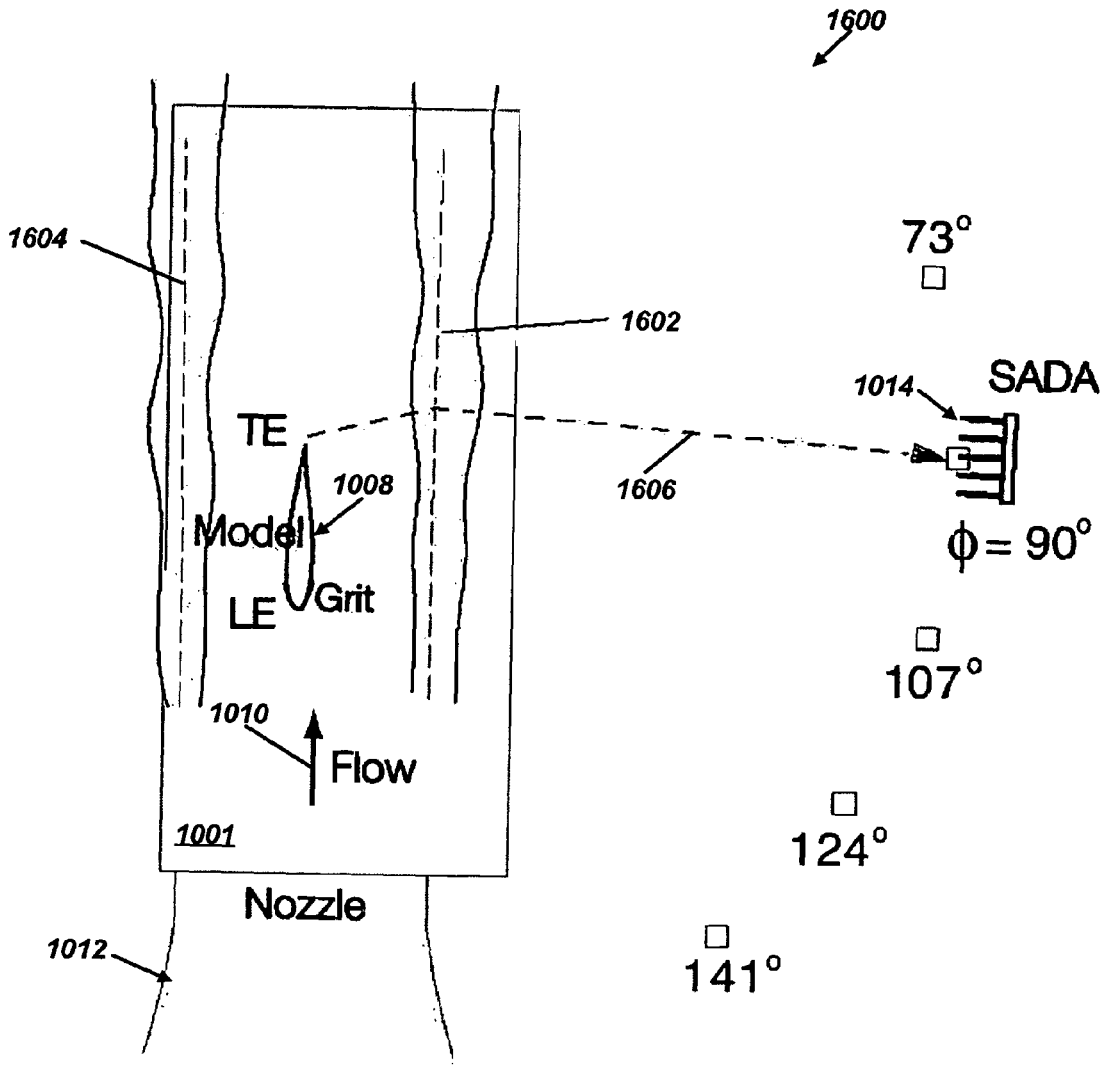
FIG. 16 illustrates a configuration of a test set-up for TE and LE noise testing, in accordance with an alternative embodiment.

A test configuration can be implemented where an airfoil, with a 16" chord and 36" span, is positioned at a −1.2° angle-of-attack to the vertical flow is depicted in FIG. 16. Note that in FIGS. 10-11 and 16, identical or similar parts or elements are generally indicated by identical reference numerals. As indicated in FIG. 16, a mean shear layer 1602 and 1604 are illustrated with respect to side-plate 1001 and flap 1008. Flow is generally indicated by arrow 1010, while a ray path 1606 to the SADA device 1014 is also depicted.

Figure 17:
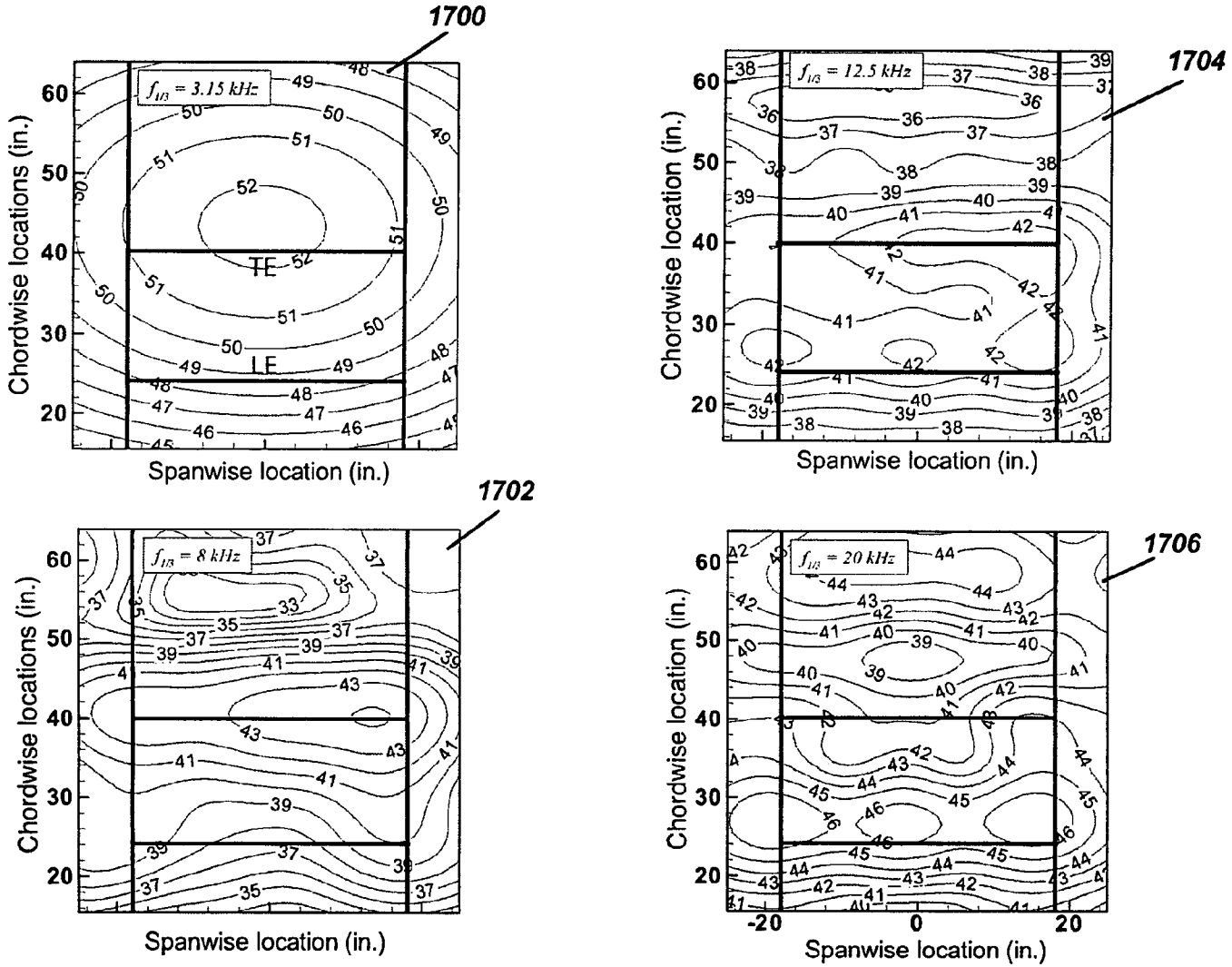
FIG. 17 and FIGS. 18(*a*)-18(*b*) illustrate SADA response contours for shaded STD processing for TE and LE noise testing, in accordance with an alternative embodiment.
Figure 18A:
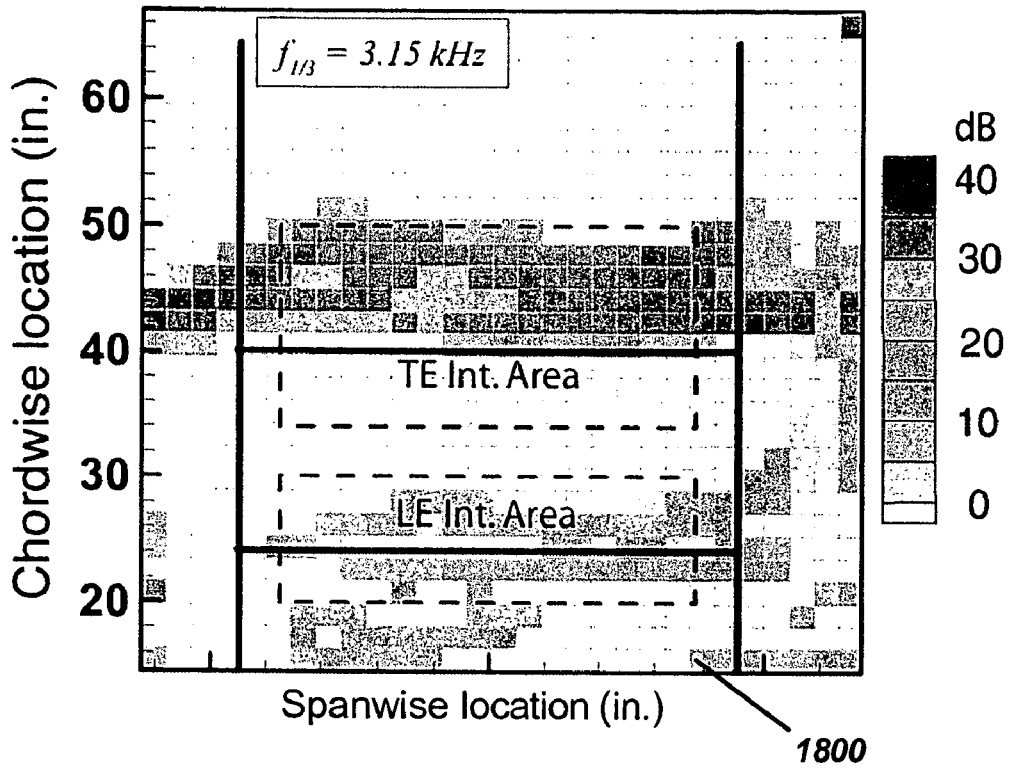
Figure 18A:
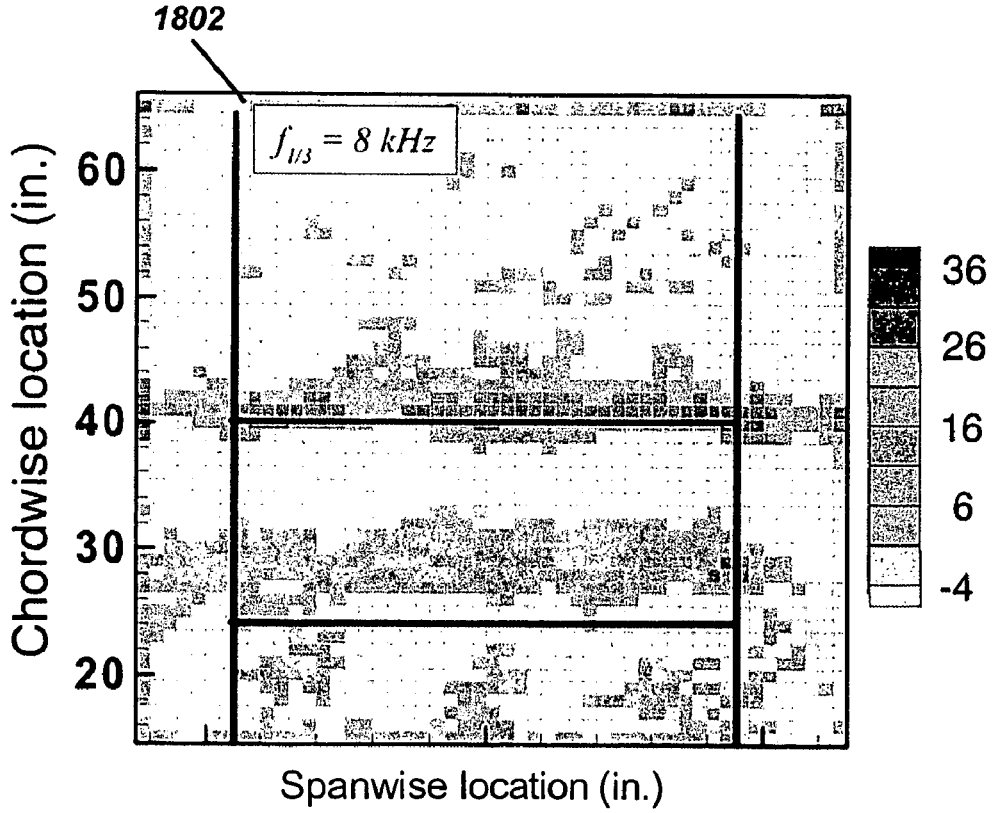
Figure 18B:
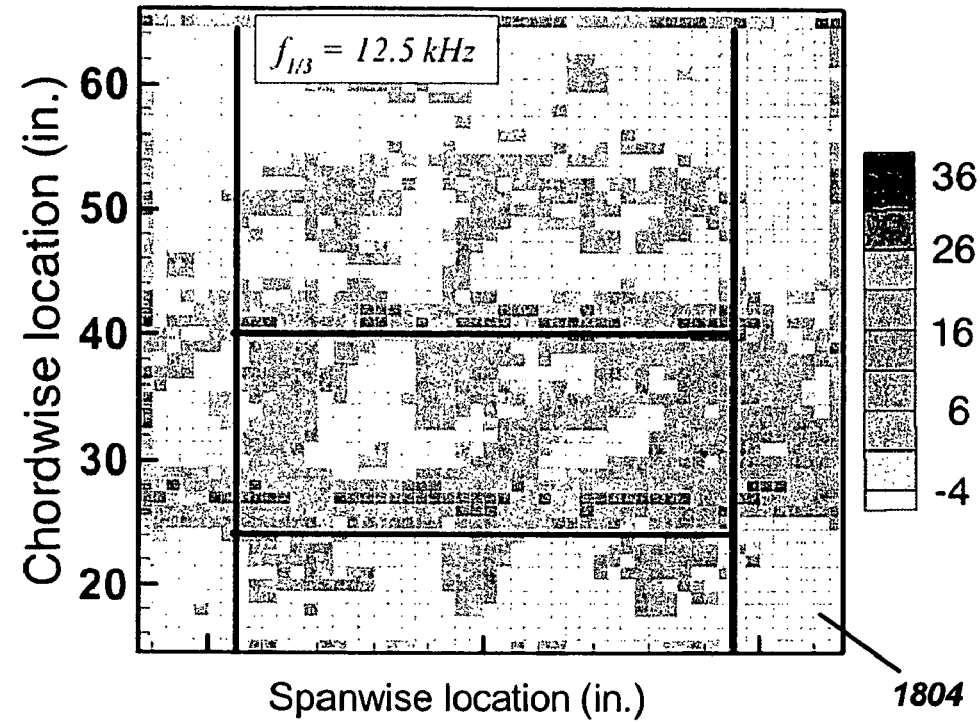
Figure 18B:
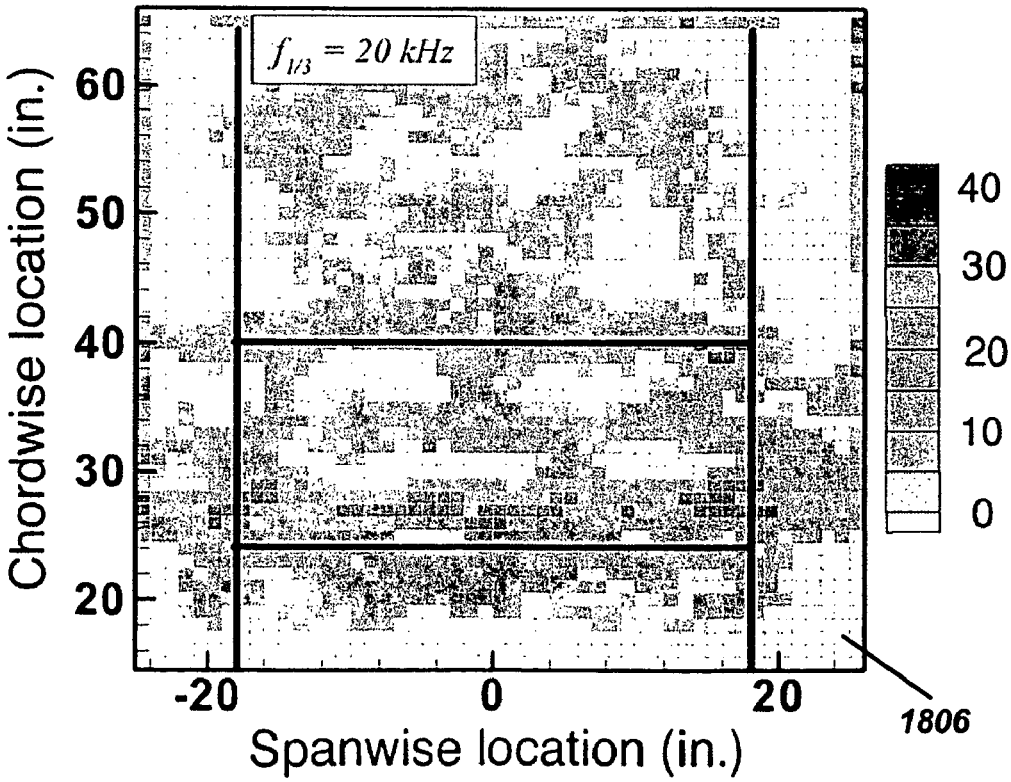

The flap 1008 can be removed and a cove thereof filled in such a manner as to produce a span-wise uniform sharp Trailing Edge (TE) of 0.005". A grit of size #90 is generally distributed over the first 5% of the Leading Edge (LE) to ensure fully turbulent flow at the TE. The SADA position is at $\phi$=90°. FIG. 16 generally illustrates the array output over a scanning plane placed through the chord-line. The scanning plane of size H=W=50" extends "beyond" the side-plates that hold the 36" span airfoil. The side-plate 1001 regions as seen from the viewpoint of the array, to the left of the −18" span-wise location and to the right of the 18" location as depicted in FIG. 17, represent reflected source regions. In general, FIGS. 17-18(*b*) illustrate SADA response contours 1700, 1702, 1704, 1705 and 1800, 1802, 1804 and 1806 for shaded STD processing for TE and LE noise testing, in accordance with an alternative embodiment.

The array output illustrated in FIG. 17 is presented for four one-third octave frequencies for STD processing with shading, equation (7). As before, individual frequency results are processed and are then summed to obtain the results shown. It is seen that for the $f_{1/3}$=3.15 kHz case, that the most intense region is just aft of the airfoil TE. As frequency is increased, the intense regions appear to first concentrate near the TE, and then to shift towards the LE.

Figure 19:
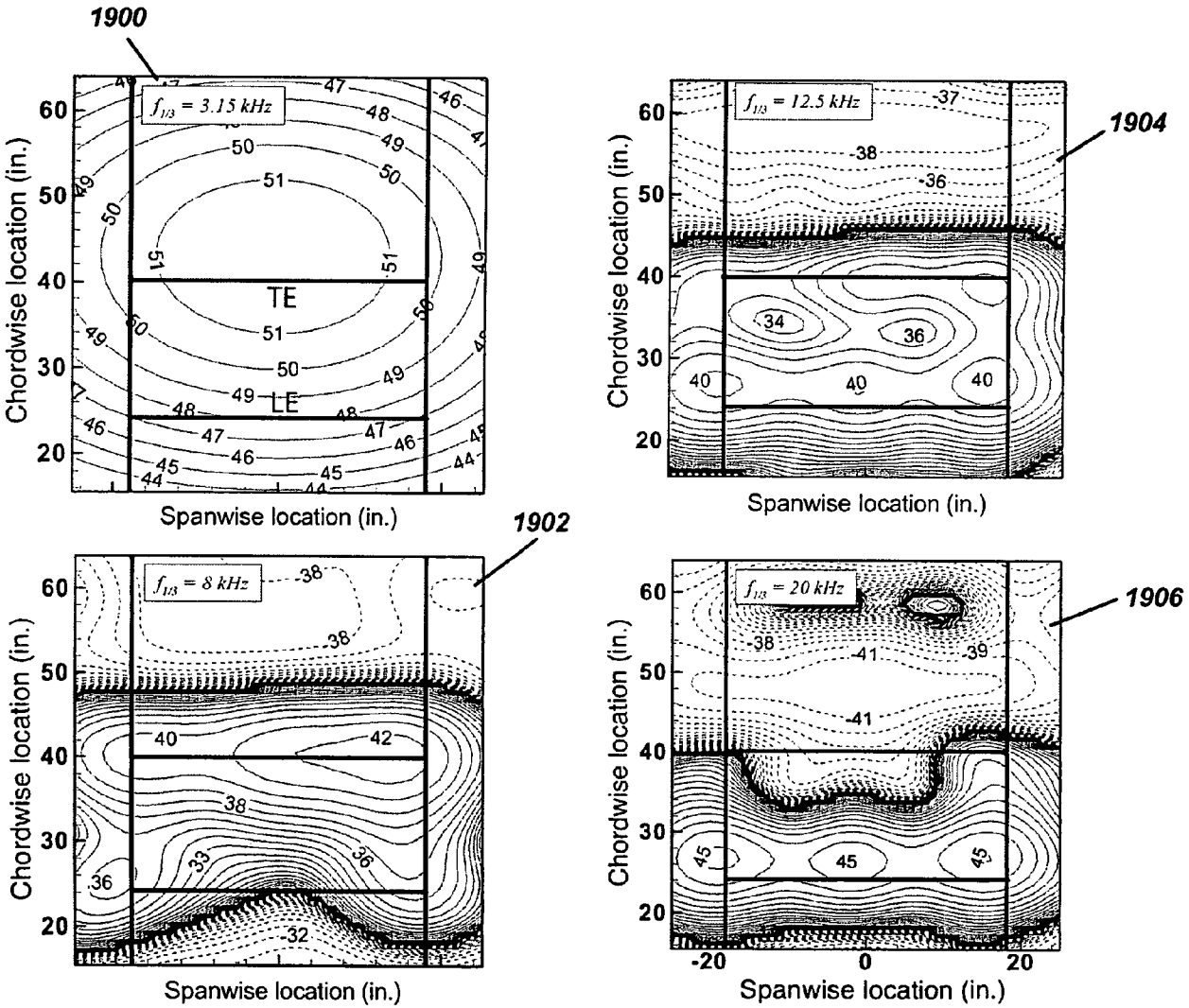
FIG. 19 illustrates DAMAS results corresponding to FIGS. 17-18, in accordance with an alternative embodiment.

FIG. 19 presents DAMAS results corresponding to FIGS. 17-18. Such results are shown as graphs 1900, 1902, 1904 and 1906. For $f_{1/3}$=3.15 kHz, $\Delta x=\Delta y$=1.8" is used to obtain the chosen lower-limit resolution of $\Delta x/B$=0.047. For 8, 12.5, and 20 kHz, the chosen $\Delta x=\Delta y$=1" give $\Delta x/B$=0.066, 0.083, and 0.083, respectively, for shaded beamforming. The results shown appear to very successfully reveal noise source distributions, even those not apparent from FIGS. 17-18. The TE and LE line sources are particularly well defined. The images at and beyond ±18 inches are model-side-plate noises and/or side plate reflections. There are apparent phantom images, particularly aft of the TE and around the edges of the scanning plane. These are addressed below.

Figure 20A:
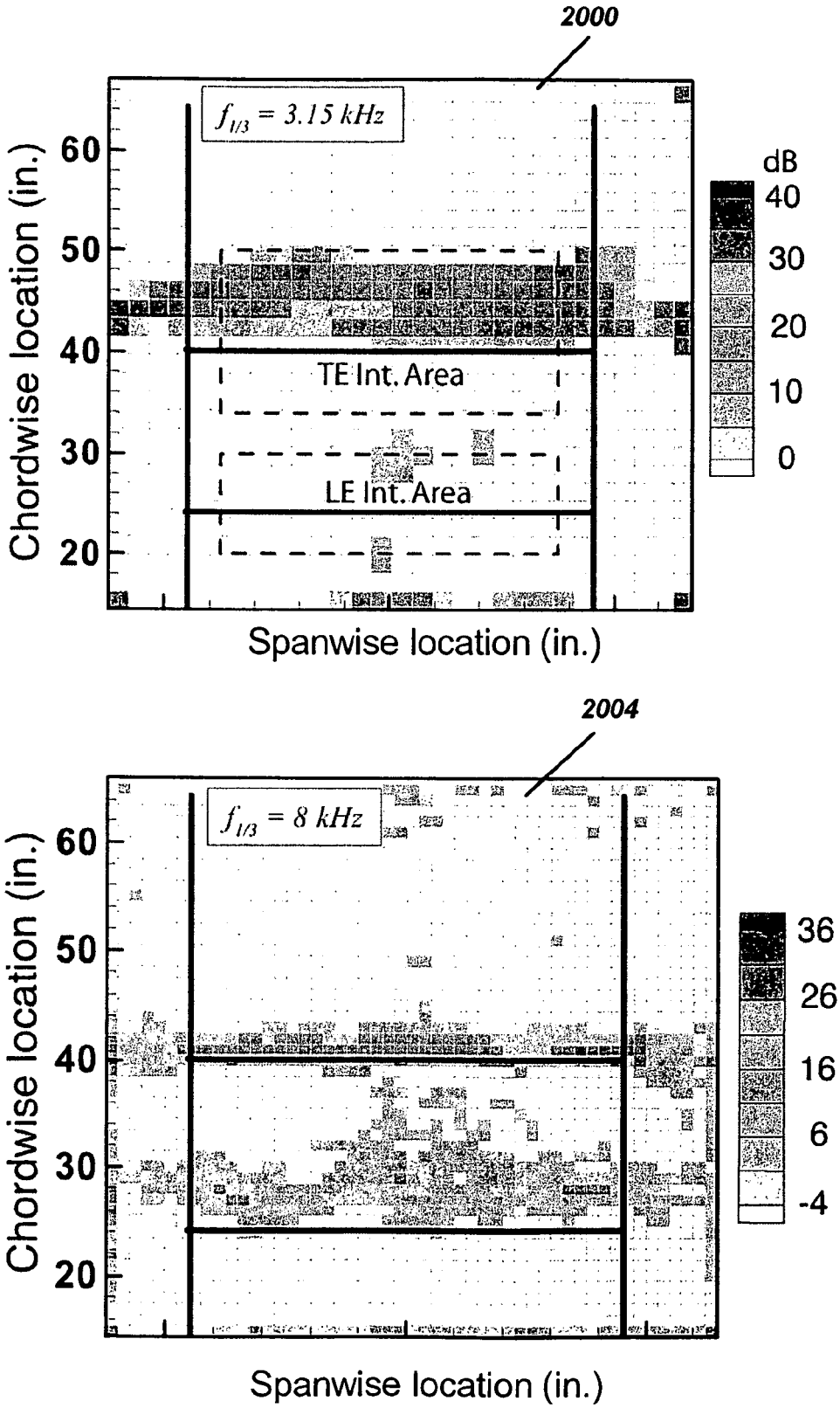
FIG. 20(*a*) and FIG. 20(*b*) illustrate SADA response contours for shaded DR processing with respect to TE and LE noise tests, in accordance with an alternative embodiment.
Figure 20B:
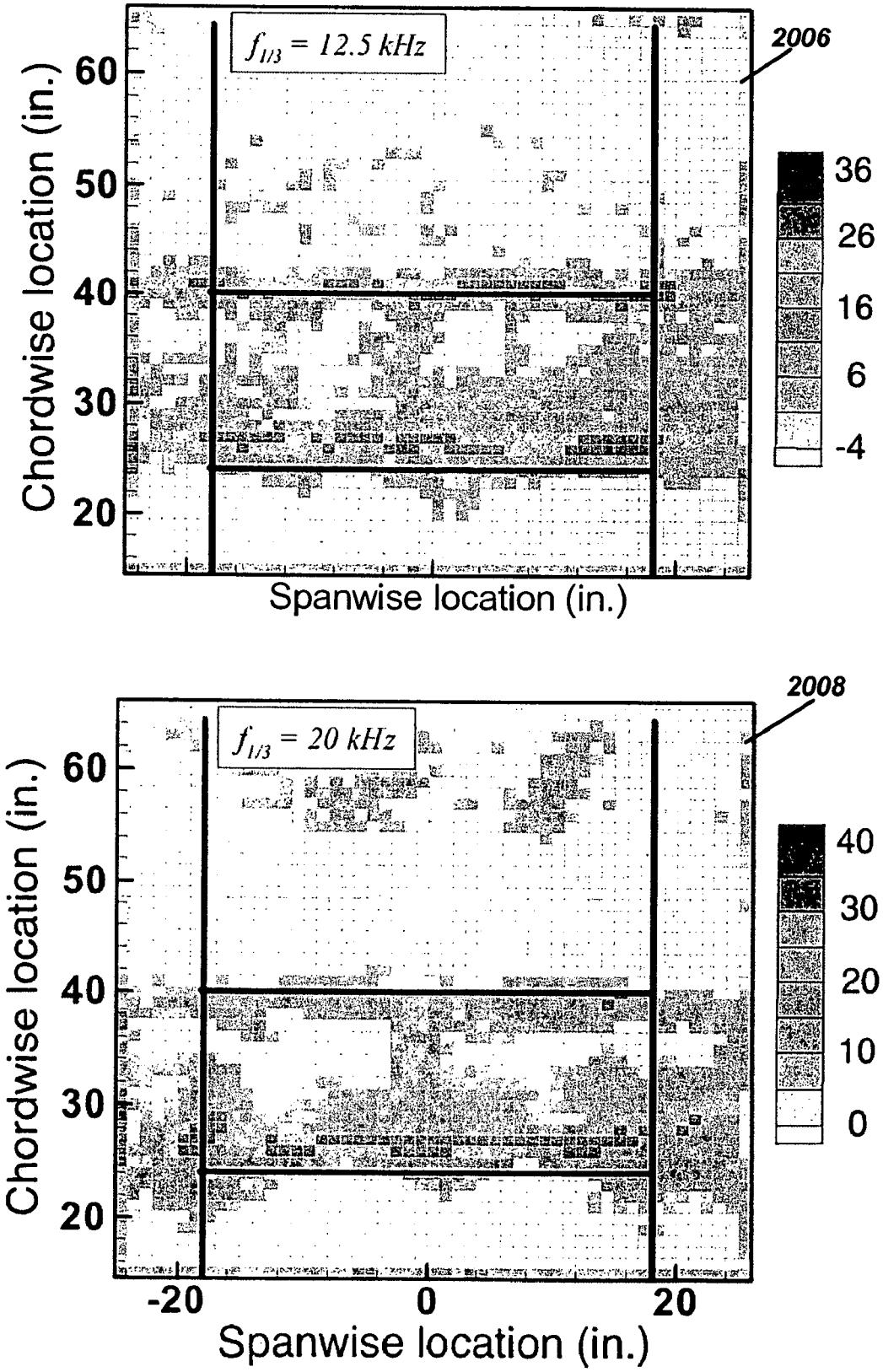

FIG. 20 generally corresponds to FIGS. 17 and 18, except that DR processing is used for beamforming, equation (9), and for DAMAS, equation (21). FIG. 20(*a*) and FIG. 20(*b*) illustrates SADA response contours 2000, 2002, 2004, 2006 for shaded DR processing with respect to TE and LE noise tests, in accordance with an alternative embodiment. The contours 2000, 2002, 2004, 2006 depicted in FIGS. 20(*a*)-20(*b*) demonstrate that although the beamforming contours differ significantly, the source distributions essentially match. The exception is that the DR results appear to produce cleaner DAMAS results, with much of the phantom images removed. That is, the apparent source distributions over regions away from surfaces where no "real" sources are likely to exist are significantly diminished. Also removed with DR is an "apparent" LE noise source distribution from the result of 3.15 kHz. Considering that the present STD method results are to some degree contaminated with turbulence buffeting microphone self noise, the DR results are considered more correct.

Note that also present in FIGS. 18(*a*)-18(*b*) are edge effects as are found in and discussed for FIGS. 12-13 and 14-15. The edge effects can be readily eliminated by expanding the scanning frame beyond the regions of strong sources, thereby reducing the edge amplitudes and thus any potential influence on the regions of interest. This has been verified but this is not shown here, as the edge effect's presence in FIG. 18(*a*) and FIG. 18(*b*) is instructive. For example, an area where the edge effect appears to negatively affect DAMAS results is the side-plate region on the left side near the LE (chord-wise location 26 in. and span-wise location −21 in.).

The strong array responses (i.e., FIGS. 17, 18(*a*), 18(*b*) and 20) at that location are not correspondingly represented by the DAMAS source distributions in that region. Instead, DAMAS puts strong sources along the scanning plane edge and the LE corner to explain the array response. (Note that it is well recognized that the array response over such a corner location may well be influenced by reflected (and thus correlated) noise sources, whereas the DAMAS modeling is based on an equivalent statistically independent source distribution. The edge effect is unrelated to this modeling/reality physical difference. Such reflections undoubtedly cause strengthening or weakening and/or shifting of apparent sources, but it would not cause source concentration along the edges.) Still, even with the scanning plane edge effect, away from the edges the TE and LE noise source regions are unaffected and the following noise spectra serve to verify this.

Figure 21:
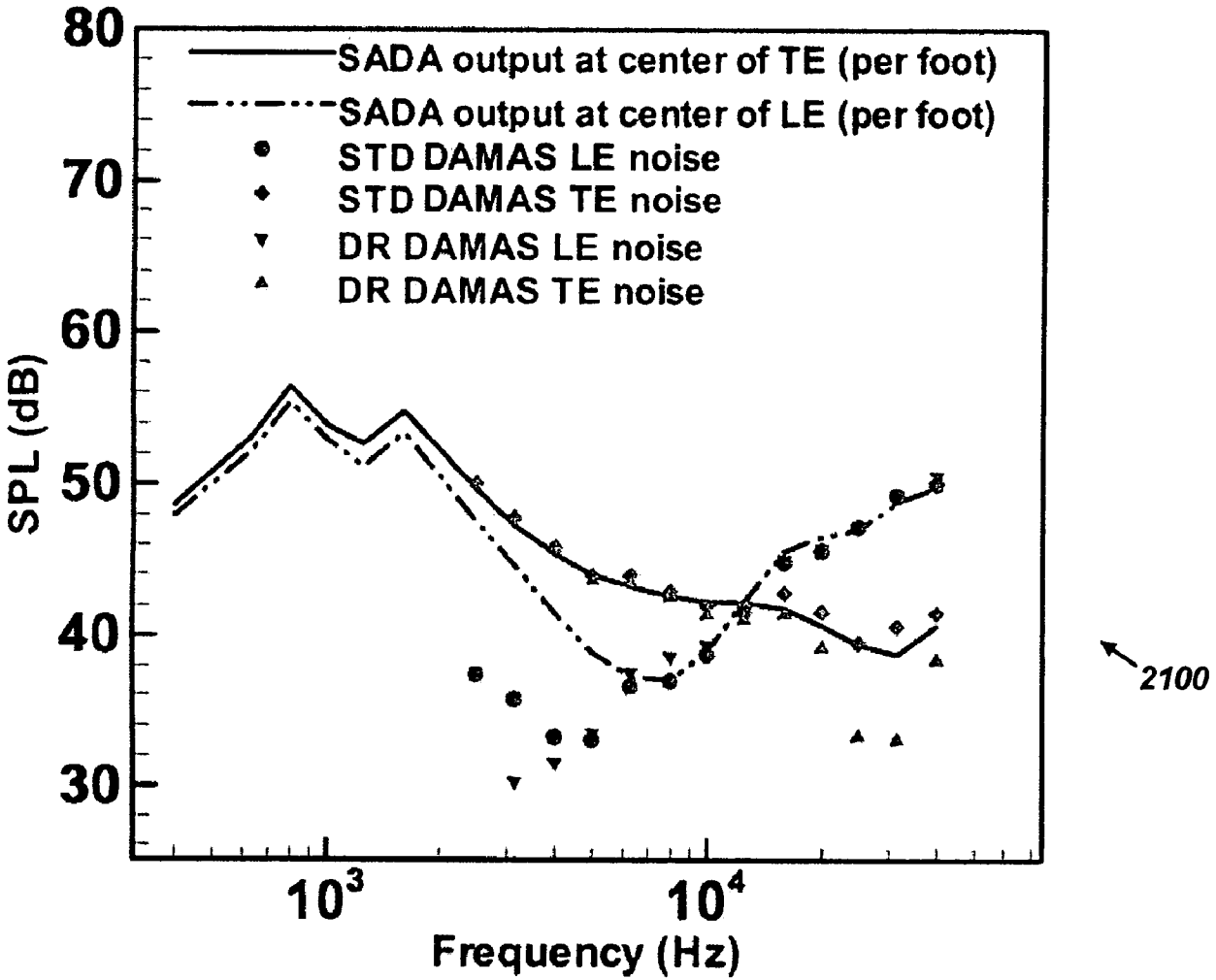
FIG. 21 illustrates a graphical representation of a comparison of one-third octave spectra from TE and LE noise measurements and reprocessing by DAMAS, in accordance with an alternative embodiment.

TE noise spectra were determined from amplitudes of the array response at the center of the TE, along with a transfer function based on an assumed line source distribution. Also, corresponding spectra from the LE noise region were determined to show grit-related LE noise, which due to beam-width characteristics were contaminated by TE noise at low frequencies. FIG. 21 illustrates a graphical representation 2100 of a comparison of one-third octave spectra from TE and LE noise measurements and reprocessing by DAMAS.

Regarding graph 2100, it is important to note that one-third octave spectra (per foot) curves for the test conditions depicted therein generally correspond to the data illustrated in FIGS. 17, 18, 19, and 12. These spectra are compared to spectra of TE noise and LE noise determined from DAMAS using both STD and DR methods. These results are determined by simply summing the pressure-squared values of each grid point within the rectangular box region surrounding the TE and LE regions shown superimposed in FIG. 19. The region's span-wise length is 2.5 feet. The sums are divided by 2.5 to put the spectral results on a per-foot basis.

The spectral comparisons are quite good and serve as a strong validation for the different analyses. Where low-frequency results of DAMAS are not plotted, the integration regions lacked contributions (not surprising with the very large beam-widths B). The spectra are seen to agree well with results over parts of the spectra where each source is dominant. Of course in such spectra shown from Ref. 4, as in the beamformed solutions of FIGS. 17, 18 and 20, the TE and LE noise region amplitudes are contaminated by the mutual influence of the other source over different parts of the spectra. The present DAMAS results exclude such interference.

Figure 22:
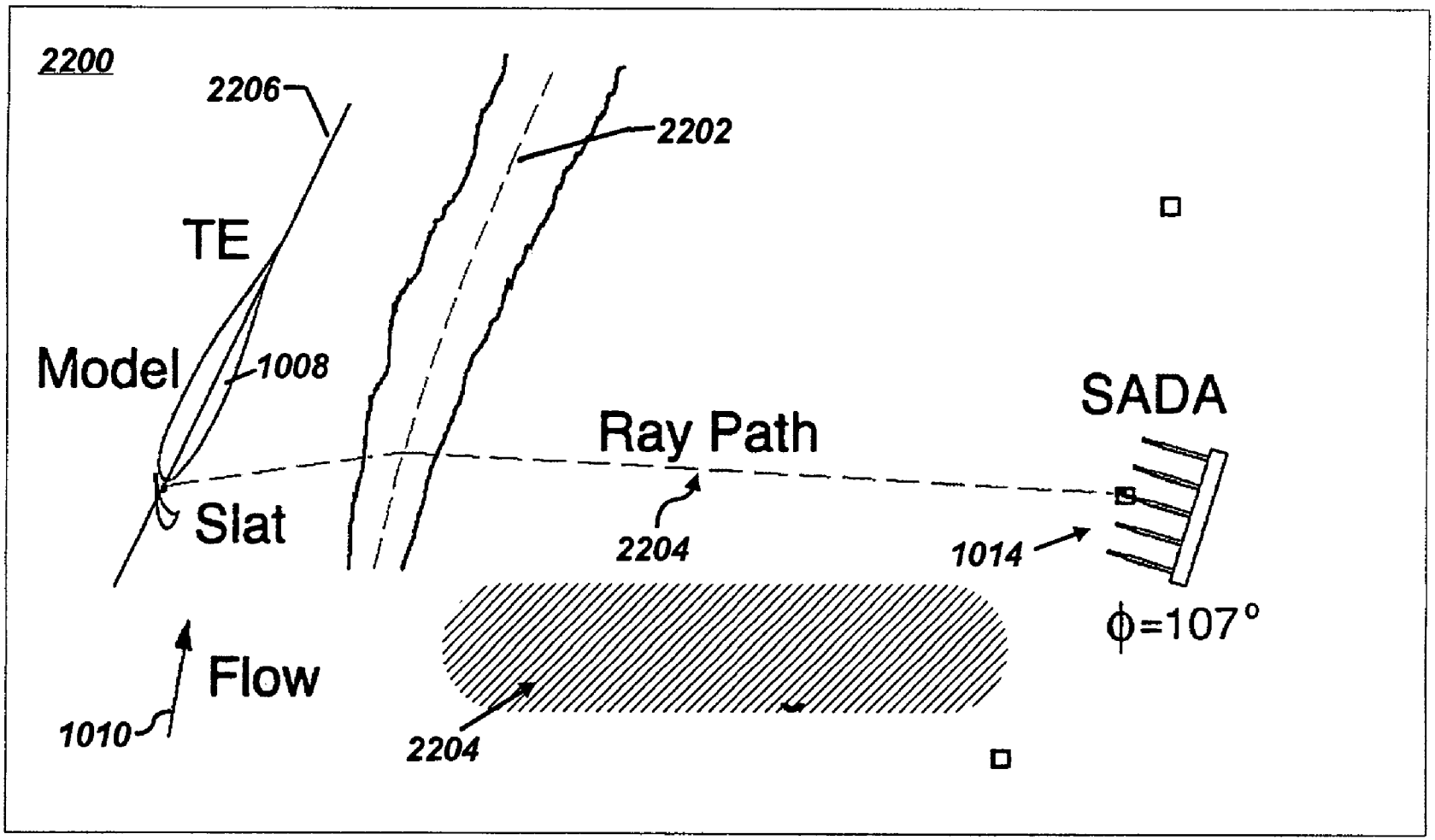
FIG. 22 illustrates shows an airfoil/slat in a deflected open jet, with a SADA positioned at $\phi$=107°.

The slat configuration tested in the QFF can be achieved by removing the flap, filling the flap cove (as for the TE noise test above), removing the grit boundary layer trip at the LE, tilting the airfoil main element to 26° from vertical, mounting the slat, and setting the slat angle and gap. The large 26° angle is required to obtain proper aerodynamics about the slat and LE region. FIG. 22 illustrates a system 2200 in which an airfoil/slat is present in a deflected open jet, with the SADA positioned at $\phi$=107°, in accordance with an alternative embodiment. Note that in FIGS. 10 and 22, identical or similar parts or components are generally indicated by identical reference numerals. System 2200 generally includes a scanning plane 2206 and a mean shear layer 2202. A ray path 2204 is also indicated in FIG. 22 as extending generally from the SADA device 1014 to the flap 1008. Airflow is indicated by arrow 1010, white a non flow region 2204 is also depicted generally in FIG. 22.

Figure 23:
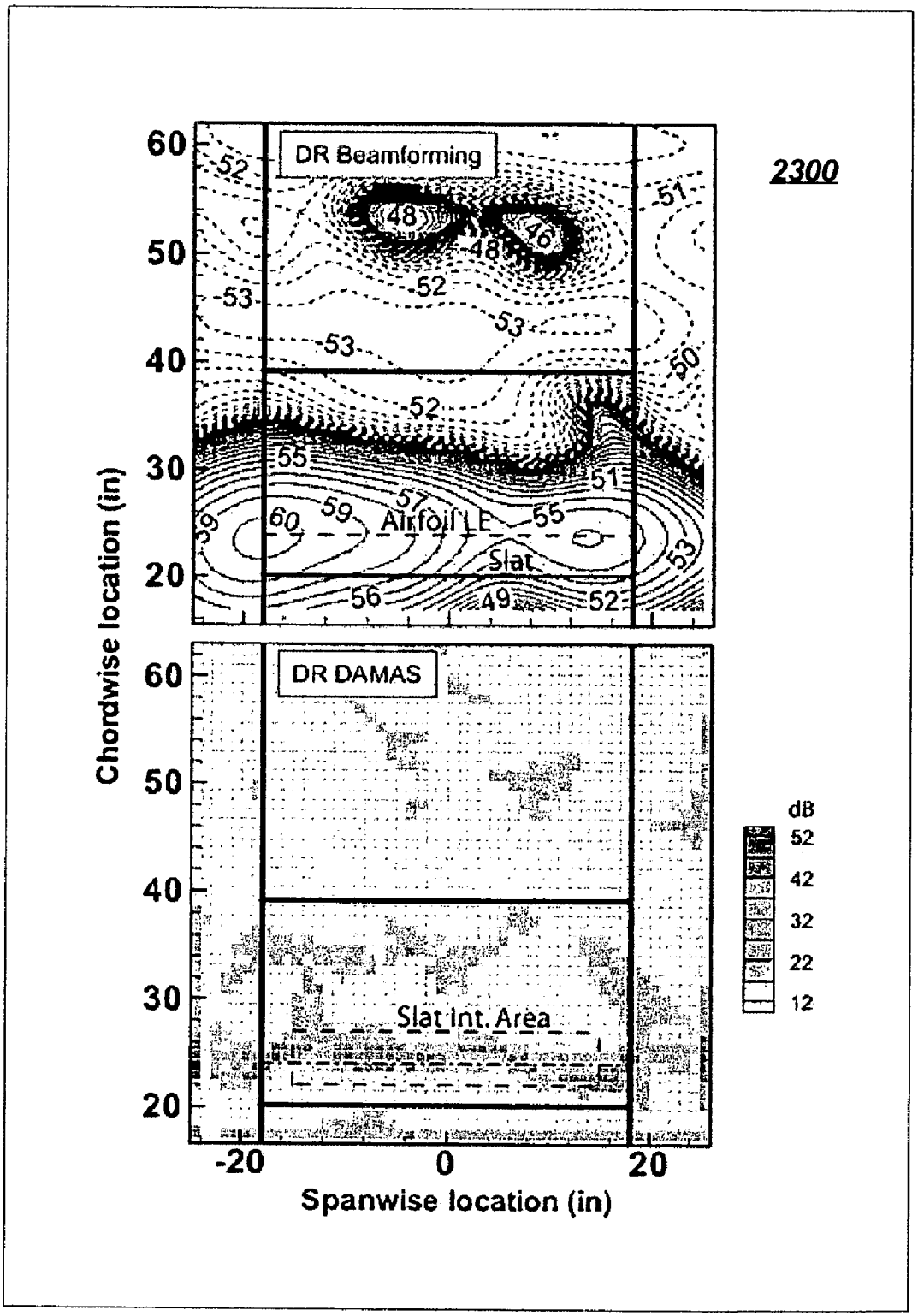
FIG. 23 illustrates the array output and corresponding DAMAS result for $f_{1/3}$=20 kHz using shaded DR processing over a scanning plane through an airfoil.

FIG. 23 illustrates a graphical representation or graph 2300 depicting an array output and a corresponding DAMAS result for $f_{1/3}$=20 kHz using shaded DR processing over the scanning plane through an airfoil. The distributed slat noise is seen to be well identified. There are higher levels toward the left side of the slat, likely due to a model mount irregularity. The aforementioned scanning plane edge effect is seen around the edge of the DAMAS presentation, and it likely has a mild impact on the source definition details at this left side. Away from the edge, the slat noise is generally uniform. The amplitude of the slat noise is determined by summing across the span within the integration box shown. For this one-third octave band, the DAMAS level of 57.9 dB (per foot) compares with 59.1 dB, which has been used as an approximate procedure involving the array output at the slat center and a derived transfer function.

Figure 24:
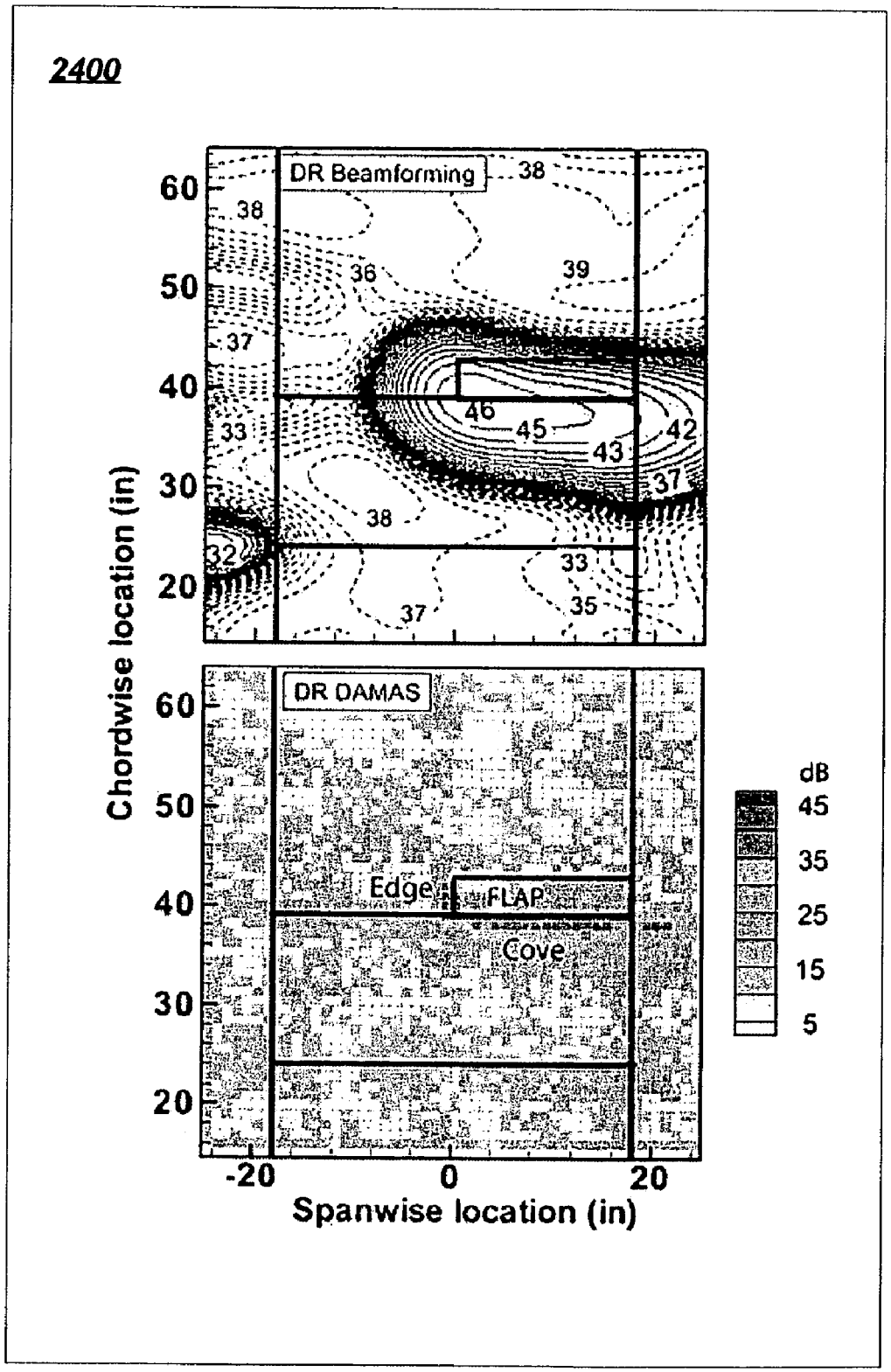
FIG. 24 illustrates beamforming contours and DAMAS results for shaded DR processing over a scanning plane placed through an airfoil chord-line.

The flap edge noise test configuration is illustrated in FIG. 12 for the SADA. The flat edge flap test condition of 29° flap angle and M=0.11 is reexamined for a one-third octave frequency band of $f_{1/3}$=20 kHz. FIG. 24 illustrates a graphical representation 2400 of beamforming contours and DAMAS results for shaded DR processing over the scanning plane placed through the airfoil chord-line. The DAMAS results appear to successfully isolate the flap edge noise from substantial flap cove noise. By using a similar rectangular integration region, shown in FIGS. 12-13 and 14-15, one finds a level of 44.6 dB for the flap edge noise. This compares to 47.5 dB for a spectrum level determined for this flap edge noise case. In that spectrum, this frequency corresponds to a localized spectral hump. These present results show that the cove noise contributed to the higher level measured. DAMAS is seen to allow one to readily separate and quantify these cover and flap edge contributions, where previously this was not possible.

The DAMAS technique described herein represents a radical step in array processing capabilities. It can replace traditional presentations of array results and make the array a much more powerful measurement tool than is presently the case. The DAMAS equation $\hat{A}\hat{X}=\hat{Y}$ is a unique equation that relates a classical beamformed array result $\hat{Y}$ with the source distribution $\hat{X}$. The sources are taken as distributions of statistically independent noise radiators, as does traditional array processing/integration analysis. DAMAS does not add any additional assumption to the analysis. It merely extracts the array characteristics from the source definition presentation. The iterative solution for $\hat{X}$ is found to be robust and accurate. Numerical application examples show that the actual rate and accuracy at which solutions converge depend on chosen spatial resolution and evaluation region sizes compared to the array beam width. Experimental archival data from a variety of prior studies are used to validate DAMAS quantitatively. The same algorithm is found to be equally adept with flap edge/cove, trailing edge, leading edge, slat, and calibration noise sources The foregoing methodology thus is generally directed toward overcoming the current processing of acoustic array data, which is burdened with considerable uncertainty. Such a methodology can serve to demystify array results, reduce misinterpretation, and accurately quantify position and strength of acoustic sources. As indicated earlier, traditional array results represent noise sources that are convolved with array beam form response functions, which depend on array geometry, size (with respect to source position and distributions), and frequency. The Deconvolution Approach for the Mapping of Acoustic Sources (DAMAS) methodology described above therefore removes beamforming characteristics from output presentations. A unique linear system of equations accounts for reciprocal influence at different locations over the array survey region. It makes no assumption beyond the traditional processing assumption of statistically independent noise sources. The full rank equations are solved with a new robust iterative method.

DAMAS can be quantitatively validated using archival data from a variety of prior high-lift airframe component noise studies, including flap edge/cove, trailing edge, and leading edge, slat, and calibration sources. Presentations are explicit and straightforward, as the noise radiated from a region of interest is determined by simply summing the mean-squared values over that region. It is believed DAMAS can fully replace existing array processing and presentations methodology in most applications. Such a methodology appears to dramatically increase the value of arrays to the field of experimental acoustics.

It is important to note that the methodology described above with respect to FIGS. 1-23 and equations (1) to (26), which is referred to generally by the DAMAS acronym, can be implemented in the context of a module(s). In the computer programming arts, a module (e.g., a software module) can be implemented as a collection of routines and data structures that perform particular tasks or implement a particular abstract data type. Modules generally can be composed of two parts. First, a software module may list the constants, data types, variable, routines and the like that that can be accessed by other modules or routines. Second, a software module can be configured as an implementation, which can be private (i.e., accessible perhaps only to the module), and that contains the source code that actually implements the routines or subroutines upon which the module is based.

Thus, for example, the term "module," as utilized herein generally refers to software modules or implementations thereof. The world module can also refer to instruction media residing in a computer memory, wherein such instruction media are retrievable from the computer memory and processed, for example, via a microprocessor. Such modules can be utilized separately or together to form a program product that can be implemented through signal-bearing media, including transmission media and recordable media.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for mapping acoustic sources determined from a phased microphone array, comprising a plurality of microphones arranged in an optimized grid pattern including a plurality of grid locations thereof, comprising the utilization of a computer to implement the steps of:

forming a linear configuration of N equations and N unknowns by accounting for a reciprocal influence of a beamforming characteristic thereof at varying grid locations among said plurality of grid locations;

iteratively determining a full-rank equation from said linear configuration of N equations and N unknowns based on a DAMAS inverse formulation; and generating an optimized noise source distribution over an identified aeroacoustic source region associated with said phased microphone array in order to compile an output presentation thereof, in response to iteratively determining said full-rank equation among said linear configuration of N equations and N unknowns, thereby removing said beamforming characteristic from said output presentation.

2. The method of claim 1 wherein said linear configuration further comprises a system of linear equations comprising $\hat{A}\hat{X}=\hat{Y}$, wherein said system of linear equations relates a spatial field of point locations with beamformed array-output responses thereof to equivalent source distributions at a same location.

3. The method of claim 2 wherein a variable $\hat{A}$ among said system of linear equations is utilized to disassociate an array thereof from acoustic sources of interest.

4. The method of claim 2 further comprising solving for a variable $\hat{X}$ among said system of linear equations comprising $\hat{A}\hat{X}=\hat{Y}$.

5. The method of claim 1 wherein iteratively determining said full-rank equation among said linear configuration of N equations and N unknowns, further comprises attaining said full rank equation utilizing a solution requirement of a positivity constraint that is equivalent to a physical assumption of statically independent noise sources associated with at least one N location thereof.

6. The method of claim 2 wherein said full-rank equation represents a rank thereof based on a number of linearly independent equations compared to a number of equations associated with said system of linear equations $\hat{A}\hat{X}=\hat{Y}$, wherein N represents a number of grid points thereof.

7. A system for mapping acoustic sources determined from a phased microphone array, comprising a plurality of microphones arranged in an optimized grid pattern including a plurality of grid locations thereof, comprising:

a linear configuration of N equations and N unknowns formed by accounting for a reciprocal influence of said beamforming characteristic thereof at varying grid locations among said plurality of grid locations;

a full-rank equation iteratively determined from said linear configuration of N equations and N unknowns based on a DAMAS inverse formulation; and an optimized noise source distribution generated over an identified aeroacoustic source region associated with said phased microphone array in order to compile an output presentation thereof, in response to iteratively determining said full-rank equation among said linear configuration of N equations and N unknowns, thereby removing said beamforming characteristic from said output presentation.

8. The system of claim 7 wherein said linear configuration further comprises a system of linear equations comprising $\hat{A}\hat{X}=\hat{Y}$, wherein said system of linear equations relates a spatial field of point locations with beamformed array-output responses thereof to equivalent source distributions at a same location.

9. The system of claim 8 wherein a variable $\hat{A}$ among said system of linear equations is utilized to disassociate an array thereof from acoustic sources of interest.

10. The system of claim 8 further comprising solving for a variable $\hat{X}$ among said system of linear equations comprising $\hat{A}\hat{X}=\hat{Y}$.

11. The system of claim 7 wherein iteratively determining said full-rank equation among said linear configuration of N equations and N unknowns, further comprises attaining said full rank equation utilizing a solution requirement of a positivity constraint that is equivalent to a physical assumption of statically independent noise sources associated with at least one N location thereof.

12. The system of claim 7 wherein said full-rank equation represents a rank thereof based on a number of linearly independent equations compared to a number of equations associated with said system of linear equations $\hat{A}\hat{X}=\hat{Y}$, wherein N represents a number of grid points thereof.

13. A program product for mapping acoustic sources determined from a phased microphone array, comprising a plurality of microphones arranged in an optimized grid pattern including a plurality of grid locations thereof, said program product comprising:

a non-transitory instruction media residing in a computer memory forming a linear configuration of N equations and N unknowns by accounting for a reciprocal influence of a beamforming characteristic thereof at varying grid locations among said plurality of grid locations;

a non-transitory instruction media residing in a computer for iteratively determining a full-rank equation from said linear configuration of N equations and N unknowns based on a DAMAS inverse formulation; and a non-transitory instruction media residing in a computer generating an optimized noise source distribution over an identified aeroacoustic source region associated with said phased microphone array in order to compile an output presentation thereof, in response to iteratively determining said full-rank equation among said linear configuration of N equations and N unknowns, thereby removing said beamforming characteristic from said output presentation.

14. The program product of claim 13 wherein said linear configuration further comprises a system of linear equations comprising $\hat{A}\hat{X}=\hat{Y}$, wherein said system of linear equations relates a spatial field of point locations with beamformed array-output responses thereof to equivalent source distributions at a same location.

15. The program product of claim 14 wherein a variable $\hat{A}$ among said system of linear equations is utilized to disassociate an array thereof from acoustic sources of interest.

16. The program product of claim 14 further comprising solving for a variable $\hat{X}$ among said system of linear equations comprising $\hat{A}\hat{X}=\hat{Y}$.

17. The program product of claim 13 wherein iteratively determining said full-rank equation among said linear configuration of N equations and N unknowns, further comprises attaining said full rank equation utilizing a solution requirement of a positivity constraint that is equivalent to a physical assumption of statically independent noise sources associated with at least one N location thereof.

18. The program product of claim 13 wherein said full-rank equation represents a rank thereof based on a number of linearly independent equations compared to a number of equations associated with said system of linear equations $\hat{A}\hat{X}=\hat{Y}$, wherein N represents a number of grid points thereof.

19. The program product of claim 13 wherein each of said instruction media residing in a computer can be utilized separately or together to form a program product capable of being implemented through tangible signal-bearing media.

20. The program product of claim 19 wherein said tangible signal-bearing media comprise at least one of the following types of media: transmission media or recordable media.

* * * * *